United States Patent [19]

Kidani

[11] Patent Number: 4,619,079

[45] Date of Patent: Oct. 28, 1986

[54] GRINDING MACHINE FOR BALL END MILLS WITH HELICAL CUTTER TEETH

[76] Inventor: Morio Kidani, Kopo Tasaka 304, 8-14, Misasamachi 2-chome, Nishi-ku, Hiroshima-shi, Hiroshima-ken 730,, Japan

[21] Appl. No.: 717,788

[22] Filed: Mar. 29, 1985

[30] Foreign Application Priority Data

Mar. 31, 1984 [JP] Japan ..... 59-64218

[51] Int. Cl.[4] ..... B24B 3/08

[52] U.S. Cl. ..... 51/165.71; 51/96; 51/225

[58] Field of Search ..... 51/3, 96, 225, 165.71, 51/165 TP

[56] References Cited

U.S. PATENT DOCUMENTS 4,115,956 9/1978 Huffman ..... 51/225

4,163,345 8/1979 Meili ..... 51/225

4,461,121 7/1984 Motzer ..... 51/165.71

*Primary Examiner*—Harold D. Whitehead

*Attorney, Agent, or Firm*—Flynn, Thiel, Boutell & Tanis

[57] ABSTRACT

A grinding machine for grinding a ball end mill which has a cutter teeth of a plain or frustconical shape in the circumference thereof and a cutter teeth of spherical shape in the tip end thereof. The grinding machine comprises a turntable for a spindle through an angle $\alpha$ of turning movement having a reference position in which the spindle extends parallel to an X-axis in a pattern of tan $\gamma \cdot F(\alpha)$, a grinding wheel mechanism tiltable laterally about a Y-axis intersecting at right angle with the X-axis and having grinding wheel shafts provided on the grinding wheel mechanism for alternatively supporting face and flank grinding wheels and a device for moving the grinding wheel shafts in order to enable the tip end of a cutter tooth being generated to lie in a prescribed point on the Y-axis at all time, characterized in that a grinding surface of the supporting face is able to contact the curved surface of a spherical cutter tooth in a prescribed point on the Y-axis, and the flank guiding wheel is tiltable dependent on the turning movement of the turntable in a pattern of tan $\gamma \cdot F' \alpha \cos \alpha$ so as to be able to contact the curved cutting edge of the spherical cutter tooth in a contact relationship at all times dependent on the shape of the flank.

4 Claims, 15 Drawing Figures

GRINDING MACHINE FOR BALL END MILLS WITH HELICAL CUTTER TEETH

BACKGROUND OF THE INVENTION

The present invention relates to a grinding machine for grinding ball end mills having helical cutter teeth.

One known grinding machine of the type described is a universal grinding machine with a turntable attachment. In operation, a ball end mill or milling cutter to be ground is fixed to a spindle of the turntable, and the turntable is turned to grind the spherical cutter teeth on the end of the milling cutter. The conventional grinding machine can grind the cutter end easily into complete spherical cutter teeth if the milling cutter being ground is a straight-tooth cutter called a slotting end mill having teeth on the circumerence parallel to the axis with zero rake angle. However, it is almost impossible for the known grinding machine to generate complete spherical cutter teeth if the teeth on the circumference are helical teeth having a large rake angle and a large helix angle of modern design for heavy-duty grinding. One practice, for example, has been to manually grind a thickness of material off an extension of the bottom of a face of the helical cutter teeth toward the axis of the milling cutter to thereby form a face in the vicinity of the tip of the spherical cutter teeth, fix the milling cutter to the spindle, and grind the spherical cutter teeth while turning the turntable. With this prior practice, however, only spherical cutter teeth similar in shape to an ellipsoidal surface of revolution can be generated dependent on the configuration of a flank grinding wheel, as described in another patent application entitled "Ball end mill with plain or tapered helical cutter teeth having a large helix angle and a large rake angle" filed by the inventor. According to another grinding practice devised by the inventor, the face of the spherical cutter teeth is first formed by a manual operation. Then, in a flank grinding process, a point guide having a height corresponding to an optimum face is positioned as closely as possible to the grinding point of the flank grinding wheel, and the tip of the face of the spherical cutter teeth is held against the point guide by rotating the spindle to keep the flank and the face in as fixed a relationship as possible to the grinding wheel while the milling cutter is being ground. However, this procedure has failed to meet fully with desired success because of the shape of the face and the position and shape of the point guide.

A couple of tool makers have recently employed a process in which manual grinding of the face of spherical cutter teeth is replaced with grinding of the face of spherical cutter teeth of a milling cutter about an axis passing through a point which lies in a plane formed by a line tangential to the face of a plain helical cutter tooth at its cutting edge at $=0$ and also by a cutting edge point of the spherical cutter teeth at the tip end thereof, which lies on a line normal to the bottom of the face, and whiel is equidistant from two points on the bottom of the face, the axis being perpendicular to the plane. With this process, however, the setting is approximate as described above and the face is a plane, so that the face will not be joined without involving a bent edge. Furthermore, in grinding a flank, spherical cutter teeth close to an accurate shape cannot even be generated without employing the process of the present invention. Since the face has a bent edge, it will leave a flaw on a workpiece surface cut thereby, making it difficult to effect a subsequent operation on the workpiece. The disadvantage with the point guide remains, so that no completely spherical cutter teeth can be generated. Recently available CNC tool grinding machines are pricipally the same as conventional tool grinding machines in mechanical construction and grinding principle, but differ therefrom only in that one-chucking heavy-duty grinding is made possible by employing a servo system for driving various shafts. Since the CNC tool grinding machine uses a computer, it requires a complex program and high-level technical skill, which cannot be provided by an person of ordinary skill in the art. Furthermore, the CNC tool grinding machine is quite expensive and has not found widespead use.

SUMMARY OF THE INVENTION

It is an object of the present invention to provide a machine for grinding a ball end mill with helical cutter teeth, which machine can easily be operated by a person of ordinary skill who can derive tan from a trigonometric function table or handle a portable electronic computer, which includes a simple and inexpensive analog calculating mecahnism and a servomechanism for increasing a drive force, for producing a ball end mill with complete helical cutter teeth.

According to the present invention, a ball end mill grinding machine has a turntable for rotating a spindle mounted thereon with a ball end mill being attached thereto dependent on an angle of turning movement of the turntable in a pattern of tan $\gamma \cdot F(\alpha)$, a mechanism adjustable for enabling grinding surfaces of face and flank grinding wheels to generate optimum face and flank of the ball end mill and for generating a cutting edge line in a fixed point on a Y-axis, the mechanism itself being tiltable laterally in a pattern of tan $\gamma \cdot F'(\alpha) \cdot \cos \alpha$ in response to the turning movement of the turntable so that the grinding surfaces of the face and flank grinding wheels will lie tangentially to the cutting edge being generated and in a constant relationship.

The foregoing arrangement for grinding spherical cutter teeth of the ball end mill requires a separate attachment for grinding plain or conical helical cutter teeth as with a known universal tool grinding machine, because the spherical cutter teeth and the plain or conical helical cutter teeth have to be ground by separate mechanisms. Therefore, a step tends to be formed between the spherical cutter teeth and the plain or conical helical cutter teeth, and many technical efforts have to be made to reduce such a step. With the above attachment used, only the plain and conical helical cutter teeth of a constant lead can be ground. Where a radius R at the tip end is small, a radius gradient t of a conical surface circumscribing spherical cutter teeth and a helix angle $\gamma$ at a junction point are large, a helix angle $\Gamma$ at the junction point varies in a pattern of $\tan \Gamma = \tan \gamma(R + L \sin t)/R$ (where L is the distance from the junction point along a conical generator, with the result that the resultant tool has an excessively large helix angle, causing an excessive biting thrust force is frequently produced axially when the tool is ground. Under the circumstance, there is a strong demand for conical helical cutter teeth having a constant helix angle. The inventor is unaware of a machine capable of grinding a tool of the type described by using a driving mechanism other than a sophisticated NC or CNC tool grinding machine. Any machine for grinding a ball end mill having complete helical cutter teeth should be capable of grinding ball end mills having conical helical cutter teeth with a constant lead and also with a constant helix angle. To meet such a demand, the ball end mill grinding machine hereinafter described is designed to incorporate various improvements in the fundamental arrangement of the invention for grinding ball end mills with complete helical cutter teeth.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
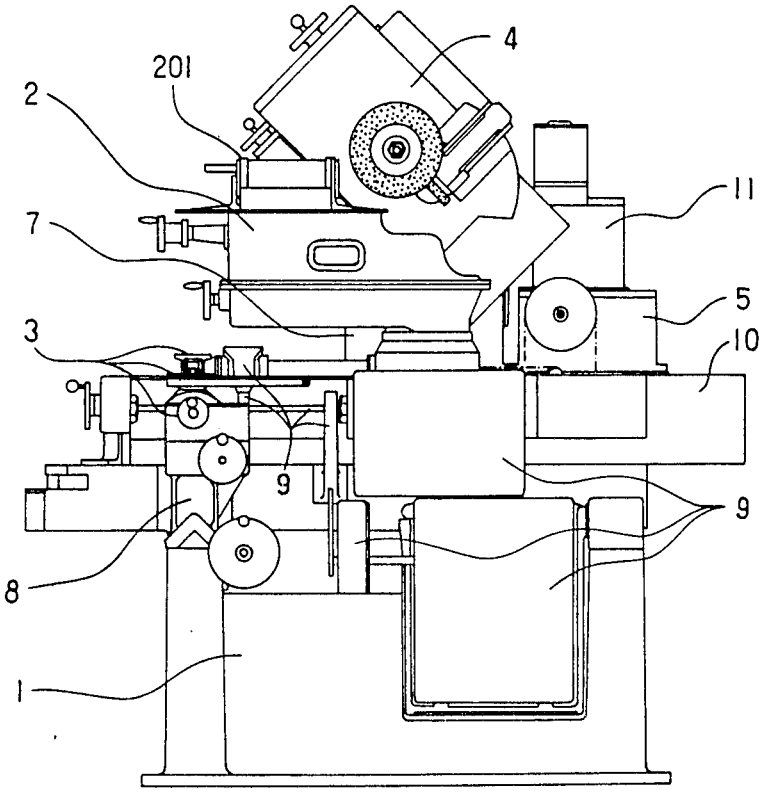
FIG. 1 is a front elevational view of a grinding machine according to the present invention for grinding ball end mills or milling cutters with helical cutter edges.
Figure 2:
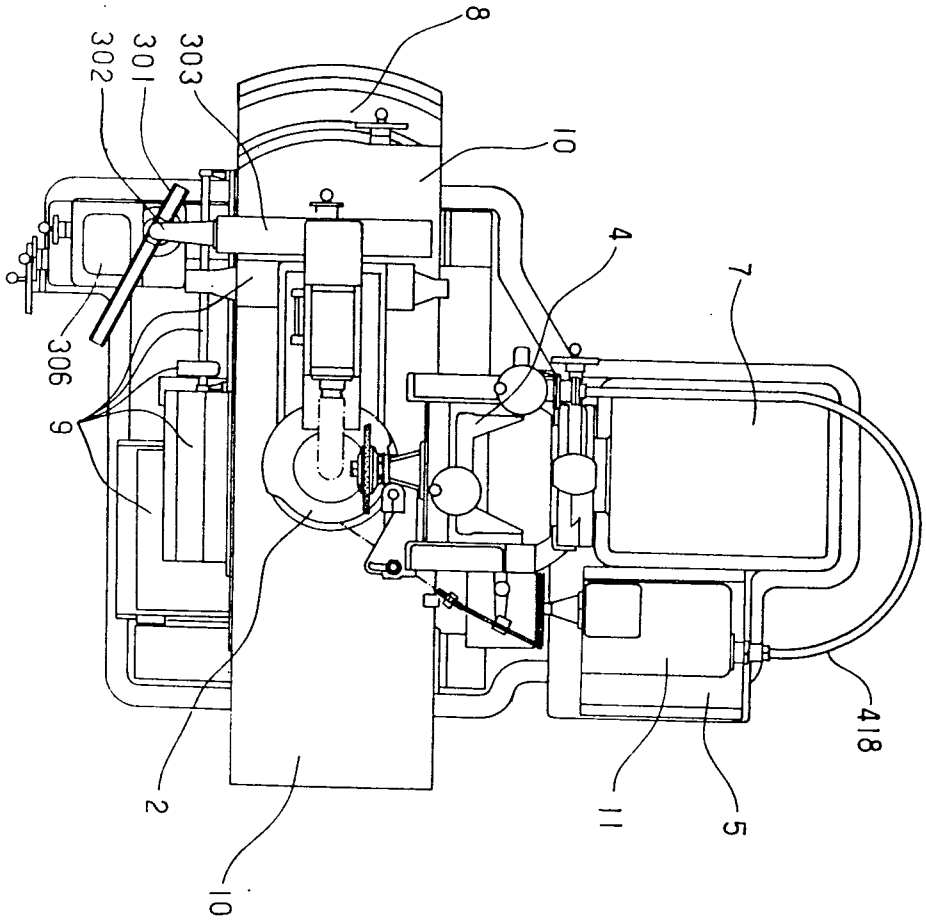
FIG. 2 is a plan view of the grinding machine shown in FIG. 1.
Figure 3:
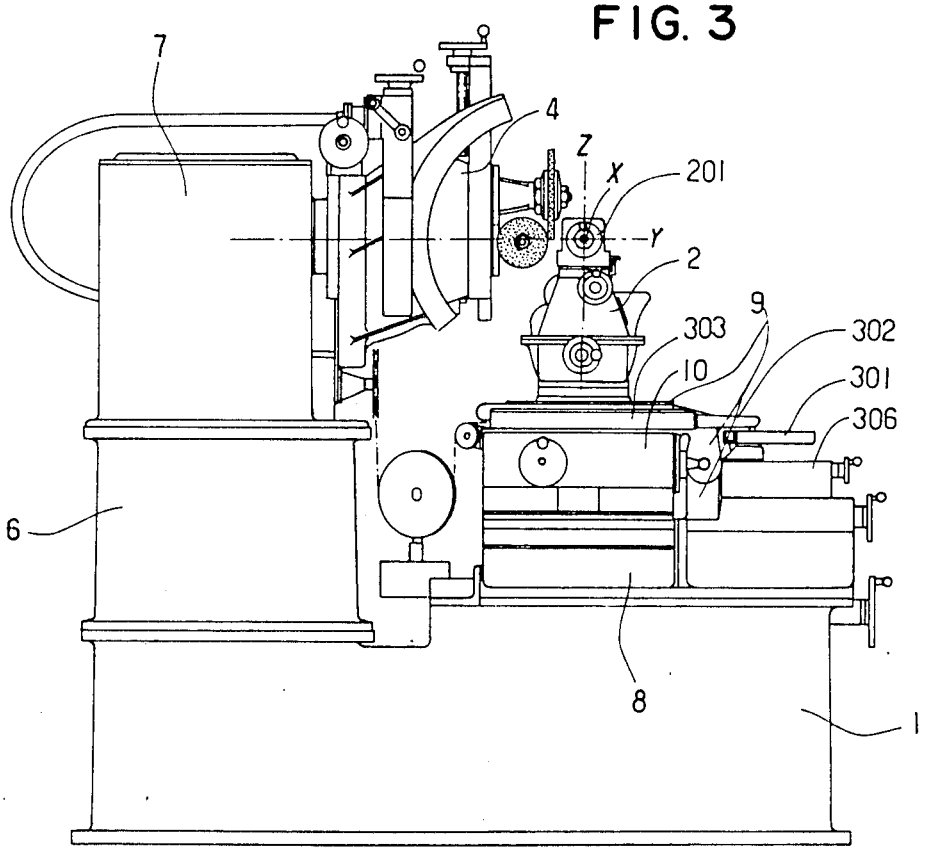
FIG. 3 is a left-hand side elevational view of the grinding machine.
Figure 4:
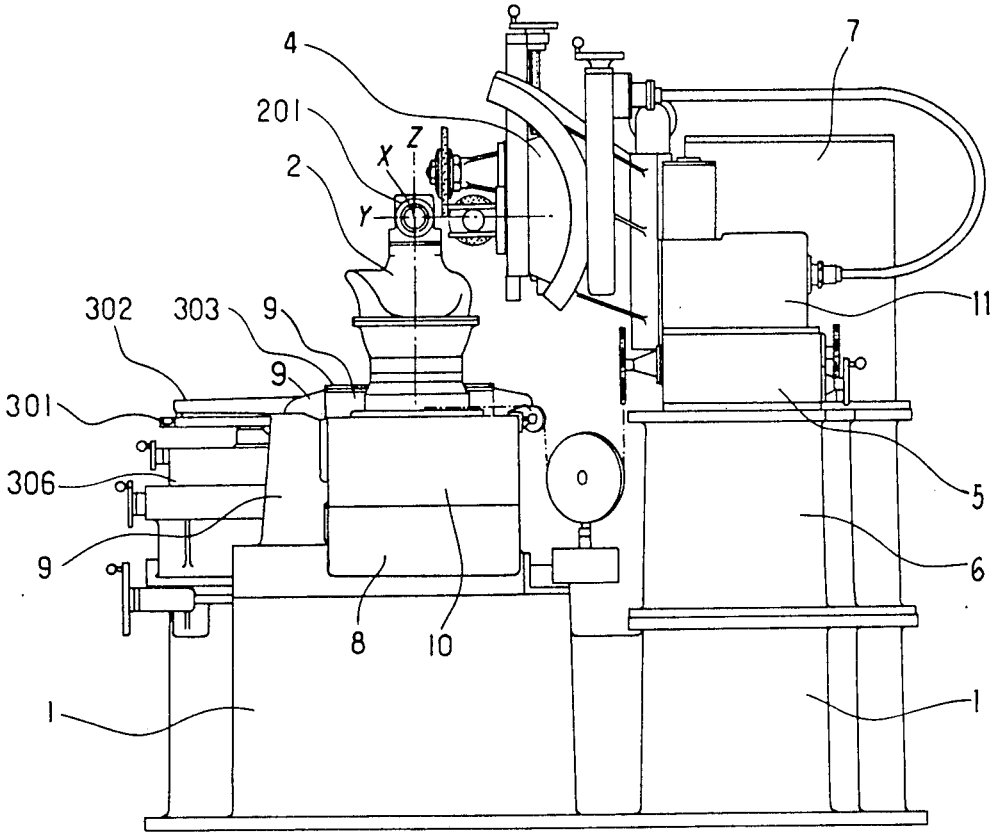
FIG. 4 is a right-hand side elevational view of the grinding machine.

FIGS. 1 through 4 illustrate a grinding machine for grinding ball end mills or milling cutters with helical cutter edges. The grinding machine includes a machine base 1, a turntable 2 supporting a spindle 201 thereon, a mechanism 3 for calculating the angle of inclination of the spindle 201 at the time of grinding plain helical cutter teeth with a constant lead, a grinding wheel mechanism 4 (shown inclined to the left through 45 degrees in FIG. 1, but in a vertical position in FIGS. 2 through 4), a mechanism 5 for calculating the angle of inclination of the grinding wheel mechanism 4 at the time of grinding spherical cutter teeth, a mechanism 6 for calculating the angle of inclination of the grinding wheel mechanism 4 at the time of grinding tapered helical cutter teeth with a constant lead, a bearing box 7 for the grinding wheel mechanism 4, a Y-direction slide table 8, a mechanism 9 for calculating the angle of inclination of the spindle 201 at the time of grinding tapered helical cutter teeth with a constant helix angle, an X-direction slide table 10, and a speed-change Norton gear box 11 for changing the speed of operation of a face grinding wheel mechanism upon grinding spherical cutter teeth.

Figure 5:
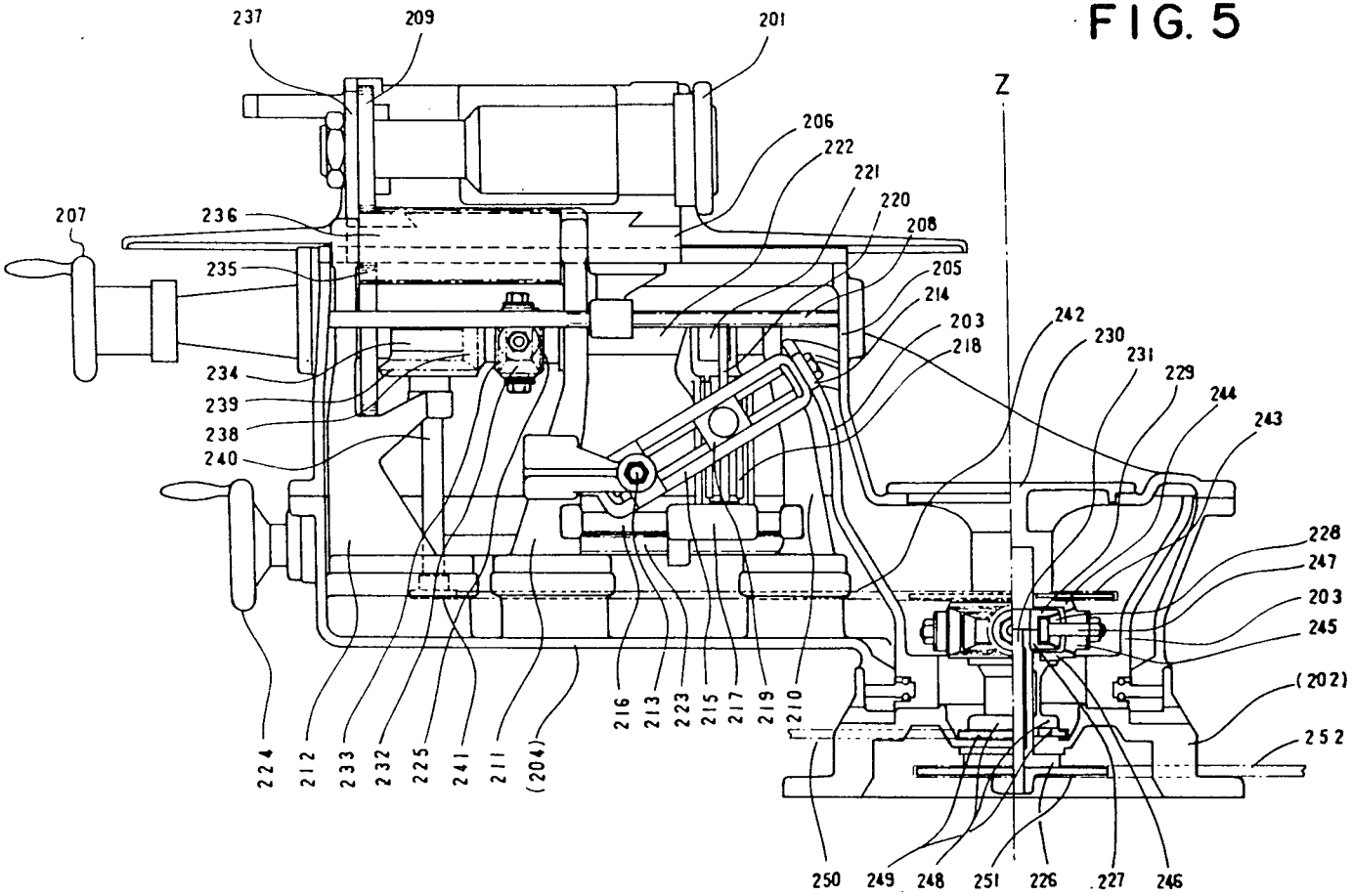
FIG. 5 is a front elevational view, with parts omitted from illustration and partly in cross section, showing a turntable turned and stopped in a direction to grind a joining point of spherical cutter teeth.

FIG. 5 shows in detail the turntable 2. The turntable 2 which is rotatable through an angle $\alpha$ includes a turntable base 202, a cam 203 fixed concentrically to the turntable base 202 and having a curved cam surface defined by a function of $\alpha$: $F(\alpha)$, a swivel base box or housing 204 and an upper swivel box or housing 205 both mounted on the turntable base 202 and rotatable about a vertical Z-axis of the turntable base 202. A spindle bearing base 206 is mounted on the upper swivel box 205. The spindle 201 is rotatably supported on the spindle bearing base 206. The spindle 201 is adjustable axially back and forth by a feed screw 208 rotatable by a handle 207 so that the axis of the spindle 201 will perpendicularly intersects the Z-axis and the central axis of spherical cutter teeth of a mill to be ground which is fastened to the spindle 201 will intersects the Z-axis. The spindle 201 comprises a hollow shaft for allowing the shank of the mill to be inserted through and fixed in a righthand end (FIG. 5) of the spindle 201, with a semi-fixed gear 209 fitted over the other end of the spindle 201. To the swivel base box 204, there are fixed a front post 210, a central post 211, and a rear post 212. Two parallel guide bars 216 extend horizontally between the front and central posts 210, 211. A slider 217 to which a vertical guideway 218 is fixed is movably mounted on the guide bars 216 and drivable by a feed screw 223 rotatable by a handle 224 disposed outwardly of the swivel base box 204. A cursor attached to the slider 217 and a scale mounted on the upper swivel box 205 allow the operator to visually confirm, through a window, the position of the slider 217 and the vertical guideway 218 from a zero point wherein the central axis of a joint pin of a slider 219 slidably fitted in the vertical guideway 218 and a guideway 215 (later described) is aligned with the central axis of a pivot shaft 213. The pivot shaft 213 is mounted on the central post 211 and has its central axis extending perpendicularly to the sheet of FIG. 5. The guideway 215 is tiltable along a path defined by $F(\alpha)$ and reciprocably fitted over the pivot shaft 213, the guideway 215 having a central axis intersecting the axis of the pivot shaft 213. The guideway 215 supports a cam follower 214 rotatably mounted on its distal end and drivable by the cam 203 in response to rotation of the turntable 2. Since the slider 219 is fitted in both the vertical guideway 218 and the guideway 215, the position of the junction pin of the slider 219 is regarded as a point of intersection of the central axes of the guideways 215, 218. When the guideway 215 is horizontal, the height of the slider 219 from the central axis is expressed by $F(\alpha)$ at a position in which the slider 217 corresponds to $\gamma=45°$ or $\tan\gamma=1$ ($\gamma$ is the helix angle at a point where plain or conical helical cutter teeth are joined to spherical cutter teeth). By setting the slider 217 to a position corresponding to desired tan $\gamma$ by rotating the handle 224, the height of the slider 219 can be expressed by tan $\gamma \cdot F(a)$. The cam 203 has a cam curve $f(\alpha)$ expressed by $f(\alpha)=R \sin(\tan^{-1} F(\alpha)/l)$ where R is the distance from the pivot shaft 213 to the center of the cam follower 214, and l is the distance from the pivot shaft 213 to the position of the slider 217 corresponding to tan 45° = 1. The distance of the slider 217 from the pivot shaft 213, corresponding to tan $\gamma$, is tan $\gamma \cdot l$. The vertical guideway 218 supports on its upper portion a clutch in which a sprocket wheel 221 is sandwiched. The sprocket wheel 221 is fitted over a spline shaft 222 extending parallel to the guide bars 216 and rotatably supported by and between the front and central posts 210, 211 and is freely movable back and forth as the slider 217 moves. An rotatable idling sprocket wheel is mounted on a lower portion of the slider 217. A chain 220 is trained around the sprocket wheel 221 and the idling sprocket wheel and has opposite ends secured taut to the slider 219. Therefore, the spline shaft 222 is rotatable to an angular extent dependent on the height of the slider 219 which is determined by the positions of the slider 217 and the cam follower 214. If the turntable 2 is to grind spherical cutter teeth only, then the spline shaft 222 has an extension extending toward the rear post 212 and to which a gear 235 is directly fixed. An elongate gear 236 is rotatably supported by and between the central and rear posts 211, 212 and extending parallel to the direction in which the spindle bearing base 206 is slidable, the elongate gear 236 being in mesh with the gear 235. The gear 209 fitted over the spindle 210 is held in mesh with the elongate gear 236, and has separate notch holes. A disk 237 having notch pins is secured to the spindle 201 in confronting relation to the gear 209. By fitting the notch pins in desired ones of the separate notch holes in the gear 209, the gear 209 and the disk 237 can rotate in unison. Providing the number of the separate notch holes is n and the number of desired notch holes used is m, the spindle 201 can be angularly moved at a desired phase difference $2\pi m/n$ in the same manner as the pattern of tan $\gamma$ $F(\alpha)$ dependent on the angle ($\alpha$) of turning movement of the swivel base box 204. With the above arrangement, a small adjustment between the phase differences $2\pi m/n$ and $2\pi(m+1)/n$ could not be achieved unless a separate adjustment mechanism were added. However, with an arrangement shown in FIG. 6, the adjustment between the phase differences can be interpolated easily by adjustably sliding a pivot base 306 supporting a proportional guideway 301 in the direction of Y-axis. The above turntable arrangement is designed for grinding spherical cutter teeth.

There is a recent demand for grinding machines to grind plain or conical helical cutter teeth and spherical cutter teeth extending therefrom through a one-chucking process. To meet such a demand, a double differential gear device and calculating mechanisms are added to the foregoing turntable arrangement for grinding spherical cutter teeth. This added arrangement allows the grinding requirement to be met by simple calculating mechanisms without having to resort to a complex electronic computer. Out of these calculating mechanisms, a calculating mechanism for grinding plain helical cutter teeth with a constant lead may be of a conventional design.

For stopping rotation of the turntable 2 to grind plain or conical helical cutter teeth and drive the spindle 201 (FIG. 5) only by an externally supplied drive force, the spline shaft 222 is required to be modified as follows: The spline shaft 222 has a hollow outer end close to the central post 211, and a differential shaft 234 is rotatably fitted in the hollow end of the spline shaft 222, with a bevel gear 225 fixed to an outer portion of the differential shaft 234. The differential shaft 234 is supported at an opposite end thereof by the rear post 212. As with the spline shaft 222 prior to being modified, the gear 235 is fixed to the end of the differential shaft 234. The differential gear unit has a radial shaft over which there is fitted a differential shaft bevel gear 232 meshing with the bevel gear 225. A bevel gear 233 is rotatably fitted over the differential shaft 234 and integral with a bevel gear 238, the bevel gear 233 being held in mesh with the differential shaft bevel gear 232 in confronting relation to the bevel gear 225. A vertical shaft 240 to which a bevel gear 239 meshing with the bevel gear 238 is fixed is rotatably supported by the rear post 212. A sprocket wheel 241 is secured to a lower end of the vertical shaft 240. When the swivel base box 204 is rotated while the vertical shaft 240 is fixed, the spindle 201 is angularly moved in a pattern of tan $\gamma \cdot F(\alpha)/2$, where the coefficient $\frac{1}{2}$ can be corrected by varying any gear ratio. When the vertical shaft 240 is rotated while the swivel base box 204 is fixed, the spindle 201 is rotated only by the vertical shaft 240.

Figure 10:
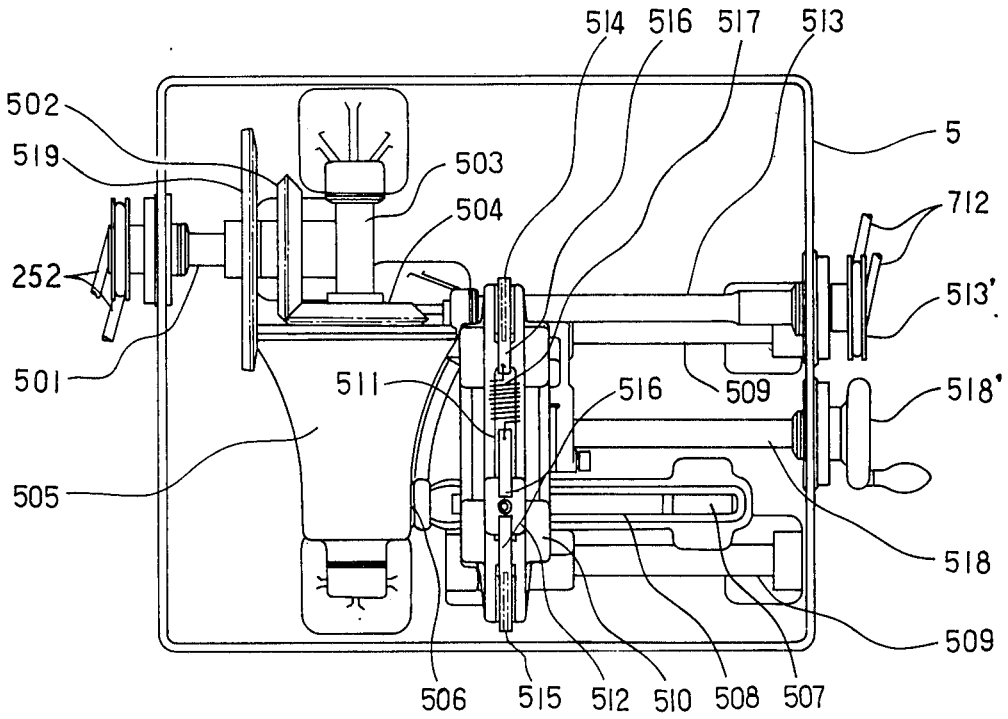
FIG. 10 is a plan view of a mechanism for calculating the angle of inclination of the grinding wheel mechanism at the time of grinding spherical cutter teeth.

The double differential gear device mounted centrally in the turntable 2 will now be described. A rotatable center piece 230 is fixed to the upper swivel box 205 at the center of rotation thereof. A rotatable shaft 231 is coaxially mounted in the rotatable center piece 230 and extends downwardly and rotatably through a coaxial hole in a base center piece 226 fixed coaxialy to a central shaft of the turntable base 202. A sprocket wheel or gear 251 is fixed to a lower end of the rotatable shaft 231. Rotary power from sprocket wheel or gear 251 is transmitted to power transmission means 252 (FIGS. 5 and 10). A bevel gear 229 of a first differential gear unit of the double differential gear device is secured to the rotatable shaft 231, and a bevel gear 227 is secured to an upper end of the base center piece 226. A differentially rotatable wheel 247 is rotatably fitted coaxially over a boss on the bevel gears 227, 229 and has a plurality of radial shafts over which bevel gears 228 are rotatably fitted in mesh with the bevel gears 227, 229. A second differential gear unit is disposed above the first differential gear unit, and has a bevel gear 244 fixed coaxially to a sprocket wheel 243 rotatably fitted coaxially over the rotatable shaft 231. Below the first differential gear unit, there is disposed a hollow shaft 248 having a lower end fixed coaxially to a sprocket wheel 249. A bevel gear 246 is fixed coaxially to an upper end of the hollow shaft 248 in confronting relation to the bevel gear 244. The radial shafts on the differentially rotatable wheel 247 have extensions over which there are rotatably fitted bevel gears 245 held in mesh with the bevel gears 244, 246. Rotation of the sprocket wheel 243 is transmitted by a chain 242 to the sprocket wheel 241 mounted on the lower end of the vertical shaft 240. The sprocket wheel 249 is driven through a chain 250 trained therearound by a mechanism 3 (described later) for calculating the angle of rotation of the spindle at the time of grinding plain or conical helical cutter teeth with a constant lead or a mechanism 9 (described later) for calculating the angle of rotation at the time of grinding conical helical cutter teeth with a constant helix angle. With such an arrangement, when the swivel base box 204 and the upper swivel box 205 are rotated while the chain 250 is held at rest (at this time, the X-direction slide table 10 is fixed, and the plain or conical helical cutter teeth are not ground, but the spherical cutter teeth are ground), the bevel gear 227 and the bevel gear 246 remain at rest, so that the differentially rotatable wheel 247 rotates through an angle which is $\frac{1}{2}$ of the angle $\alpha$ of rotation of the bevel gear 229, that is, the angle $\alpha$ of rotation of the swivel base box 204 and the upper swivel box 205. At this time, the bevel gears 245 (the radius of the pitch circle=r) on the differentially rotatable wheel 247 are in mesh with the bevel gear 246 (the radius=R) which is held at rest, and the radial shafts of the bevel gears 245 revolve through the angle of $\alpha/2$, so that the bevel gears 245 rotate about their own axes through an angle of $\alpha/2$ R/r. Therefore, the bevel gear 244 is rotated through $\alpha/2$ R/r r/R, that is, $\alpha/2$. Since the radial shafts of the bevel gears 245 have already revolved $\alpha/2$, the bevel gear 244 is rotated through an additional angle of $\alpha/2$, and hence a total angle of $\alpha$. This indicates that the bevel gear 244 and the sprocket wheel 243 connected thereto are rotated through the angle $\alpha$ of rotation of the swivel base box 204, and also that if the sprocket wheel 249 remains fixed, then the sprocket wheel 243 is angularly moved in unison with the swivel base box 204. As a consequence, the spindle 201 rotates through tan $\gamma \cdot F(\alpha)$ solely in response to the rotation of the swivel box 204 without being influence in any other way. If, on the other hand, the chain 250 is driven while the swivel base box 204 and the upper swivel box 205 are fixed against rotation, the bevel gears 227, 229 are not rotated, and hence the differentially rotatable wheel 247 is prevented from rotation. Since the chain 250 is driven by the external drive source, the sprocket wheel 249, the hollow shaft 248 fixed thereto, and the bevel gear 246 fixed thereto are driven to rotate. The differentially rotatable wheel 247 and the radial shafts thereof are prevented from rotation, as described above, and therefore the bevel gears 245 meshing with the bevel gear 246 are driven thereby to rotate about the radial shafts as held at rest, while being prevented from revolving around. The bevel gear 244 held in mesh with the bevel gears 245 rotate in a direction opposite to the direction in which the bevel gear 246 rotate and through the same angle as that of rotation of the bevel gear 246, thus rotating the sprocket wheel 243 secured to the bevel gear 244 to thereby drive the chain 242. The spindle 201 is now driven by the chain 242 in the manner described above. Therefore, the double differential gear device allows the spindle 201 to be driven independently from two separate sources.

Figure 7:
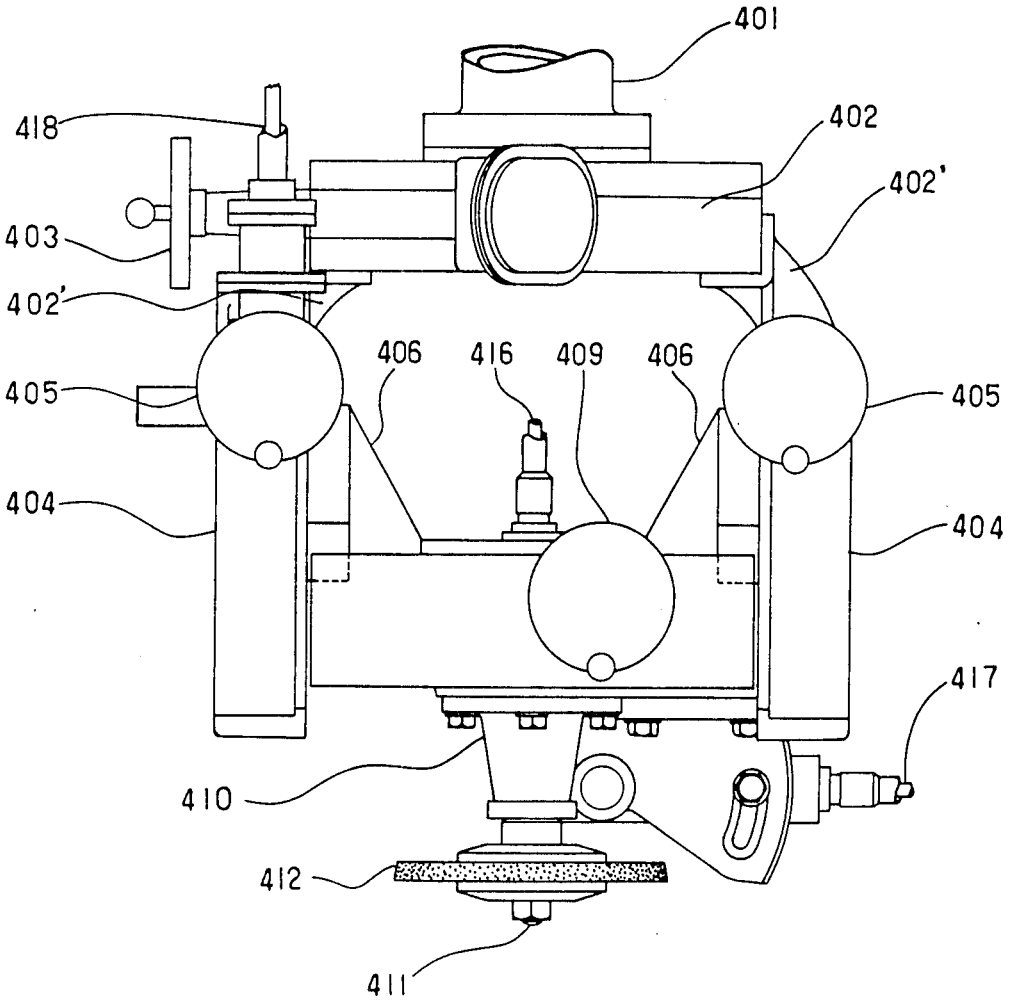
FIG. 7 is a plan view of a laterally tiltable grinding wheel mechanism in the grinding machine of the invention.
Figure 8:
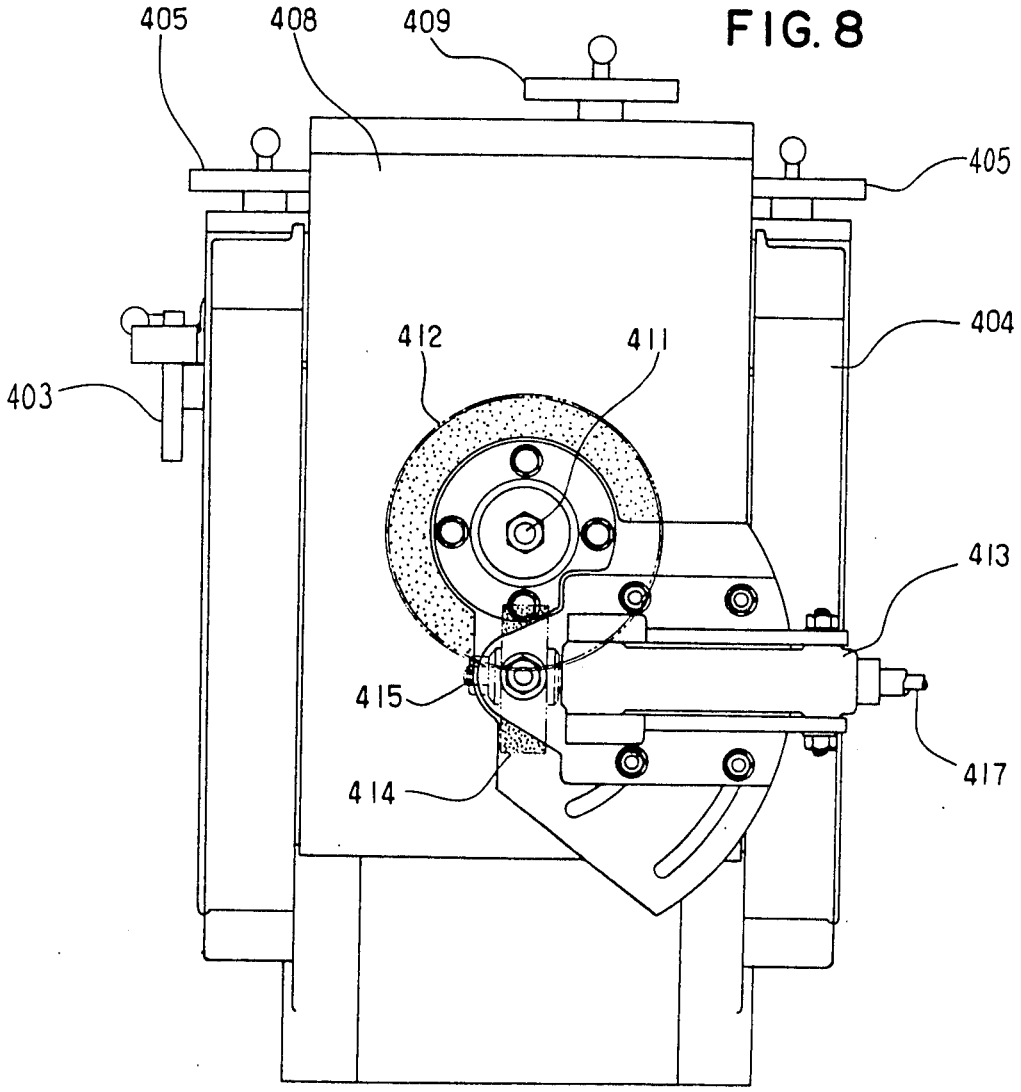
FIG. 8 is a front elevational view of the laterally tiltable grinding wheel mechanism.
Figure 9:
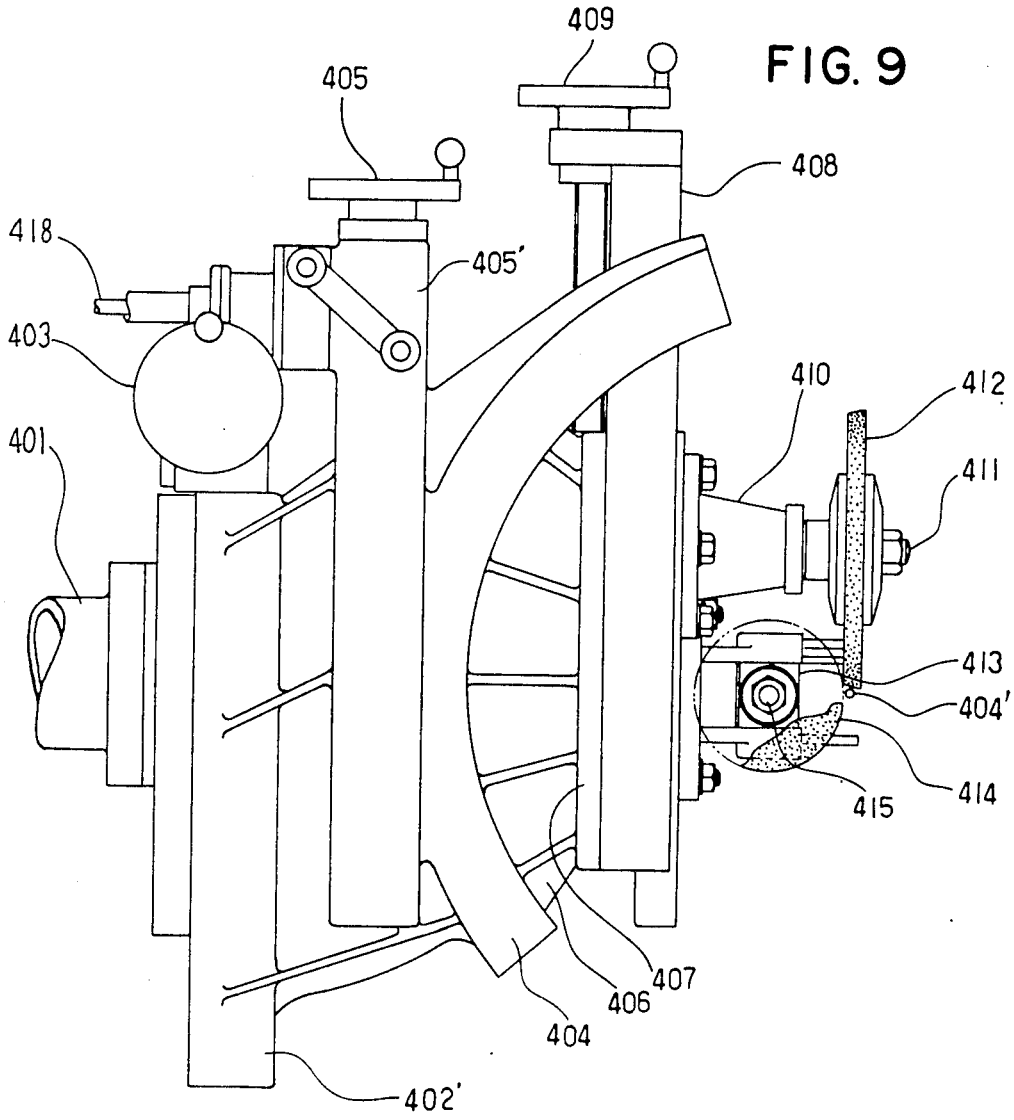
FIG. 9 is a left-hand side elevational view of the laterally tiltable grinding wheel mechanism.

The grinding wheel mechanism 4 is illustrated in detail in FIGS. 7, 8, and 9. The grinding wheel mechanism 4 is tiltable in its entirety along a path corresponding to the curve of a generated cutter edge at a certain point on the Y-axis. The grinding wheel mechanism 4 can be tilted by a mechanism which will be described later on. The grinding wheel mechanism 4 includes a shaft 401 fitted and supported in the grinding wheel mechanism bearing box 7. A first up-and-down plate 402 can be moved up and down by a handle 403, with support side arms 402' fixed to the plate 402 at lateral sides. Each support side arm 402' supports thereon an arcuate guideway 404, a handle 405 for driving an arcuate slider (not shown), and a feed mechanism 405'. The arcuate slider is fixed to a side of each swing body 406 and is slidably fitted in the arcuate guideway 404 and drivable by the handle 405 and the feed mechanism 405'. The swing body 406 has a support 407 by which there is slidably supported a second up-and-down plate 408 which is vertically movable by a handle 409. On the second up-and-down plate 408, there are mounted a bearing 410 supporting a shaft 411 to which a face grinding wheel 412 is secured and a bearing 413 supporting a shaft 415 to which a flank grinding wheel 414 (shown by the dot-and-dash line as it is mounted alternatively to the face grinding wheel 412). The bearing 410 is shown as being fixed perpendicularly to the second up-and-down plate 408, but may appropriately be inclined. Since there is a best angle at which the flank grinding wheel 414 should be inclined for the curve of the cutter edge, the flank grinding angle 414 should preferably be semi-fixed and tiltable in a wide range of angles by the illustrated arrangement. In the illustration, the face and flank grinding wheel shafts 411, 415 are driven by flexible shafts 416, 417, respectively. The arcuate slider of the swing body 406 is drivable by a flexible shaft 418 directly coupled to the speed-change Norton gear box 11 (FIG. 1) which retracts the face grinding wheel 412, as described in detail with reference to FIG. 14. To generate a cutter edge on the Y-axis, the grinding surface of the face grinding wheel 412 should be finished to have an optimum radius of curvature. To meet such a requirement, a dresser is disposed immediately below a point of intersection between a vertical line passing through a center 404' of rotation of the swing body 406 and the Y-axis. The first up-and-down plate 402 is vertically adjusted in position so that the center 404' will be higher than the dresser by the radius of curvature as referred to above. The swing body 406 is then angularly moved vertically by the handle 405 to finish the grinding surface of the face grinding wheel 412. To achieve a desired rake angle on the Y-axis, the center of the curve of the face, i.e., the center 404' should be located on a line normal to the face of the cutter edge on the Y-axis and be spaced from the point by the radius of curvature. Providing the height of the center 404' from the Y-axis is expressed by H, H=R cos $\delta$(R=radius of curvature, $\delta$=rake angle), and the height can be established by vertically adjusting the first up-and-down plate 402. Since the cutter edge is to be generated on the Y-axis, the cutter edge should be formed on a point of R sin $\delta$ directly below the center 404'. Providing the radius of the spherical cutter teeth is expressed by r, the Z-axis should be extablished in a position of r−R sin·$\delta$ directly below the center 404' on a side opposite to the generated cutter edge through an adjustment by sliding the Y-direction slider 8. The foregoing process should be effected while the grinding wheel mechanism 4 is held in an upstanding position on the condition that the generated cutter edge extends parallel to an X-Y plane.

Figure 12:
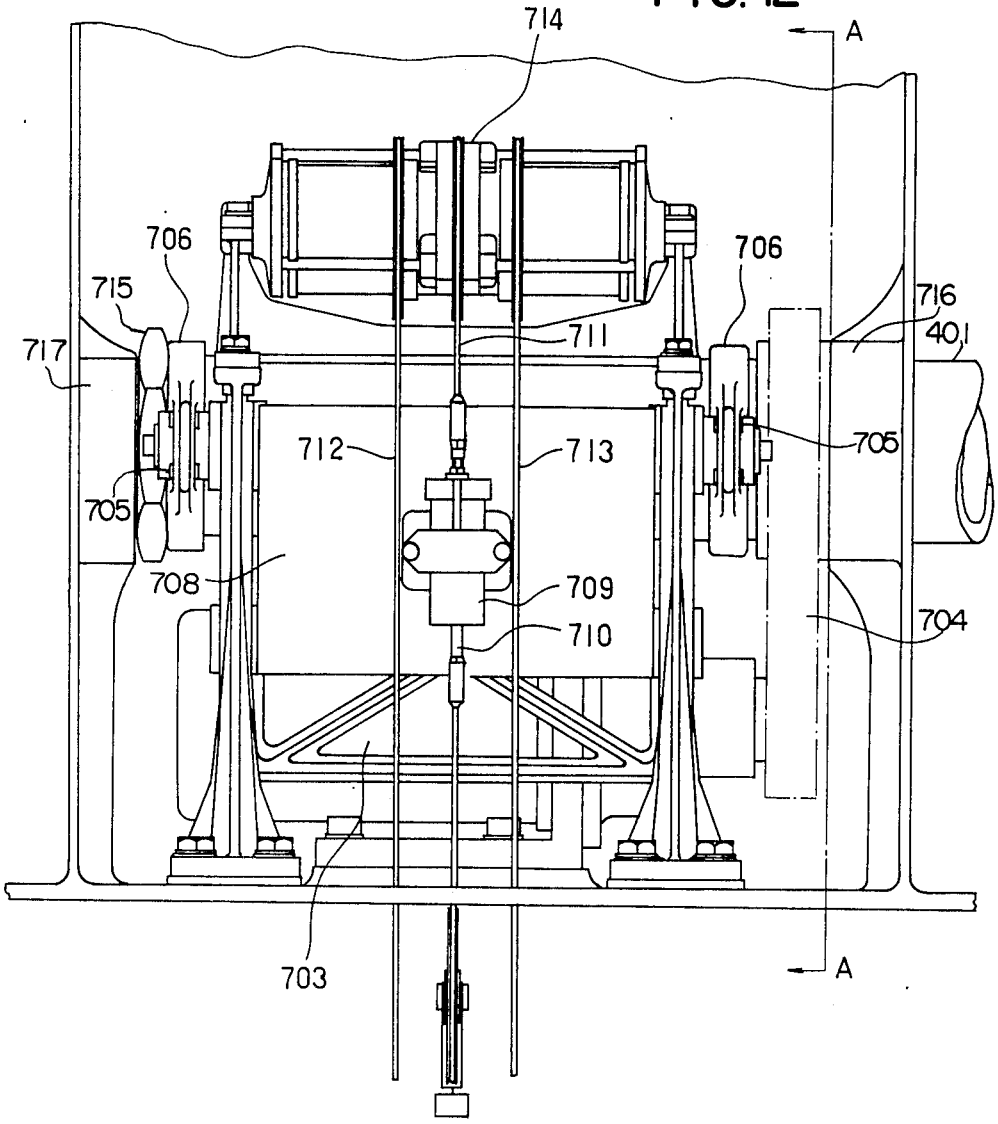
FIG. 12 is a side elevational view, with parts omitted from illustration, of a bearing housing for the grinding wheel mechanism.
Figure 13:
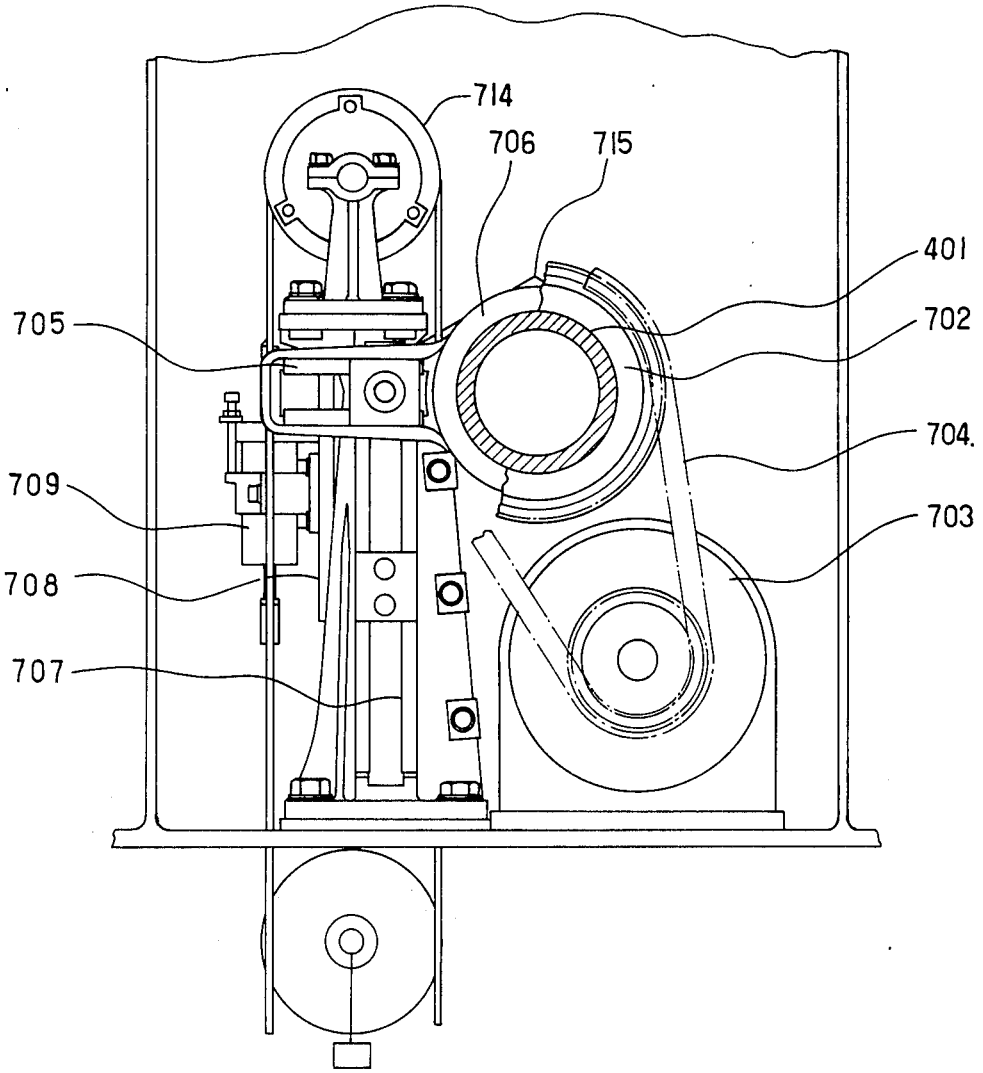
FIG. 13 is a vertical cross-sectional view taken along line 13—13 of FIG. 12.

FIG. 12 illustrates the interior of the bearing box 7 in which there extends the shaft 401 supporting the grinding wheel mechanism 4, and FIG. 13 shown in cross section of the bearing box 7. Since the grinding wheel mechanism 4 has a large mass having an eccentric center of gravity, it cannot be driven directly by an output from a mechanism (described later) for calculating tan $\gamma \cdot F'(\alpha)$ cos $\alpha$ which is driven by the turntable 2 that is manually driven. Therefore, the bearing box 7 houses therein a power booster device. More specifically, a sprocket wheel 702 is secured to the grinding wheel mechanism shaft 401 and driven through a chain 704 by a servomotor 703. Tiltable guideways 705 are mounted by bosses 706 on the shaft 401 at axially spaced locations, as shown in FIG. 12, so that the central axes of the guideways 705 will lie horizontally when the grinding wheel mechanism 4 is in the upstanding position. Upstanding guideways 707 are attached to inner sides of the tiltable guideways 705, respectively. An up-and-down plate 708 is vertically slidably fitted in the upstanding guideways 707 by means of four upper and lower pins, the two upper pins being slidably fitted in the tiltably guideways 705. When the grinding wheel 4 is tilted by the angle of $\gamma$ as shown in FIG. 1, the up-and-down plate 708 is lowered a distance of tan $\gamma \cdot D$ from the position wherein $\gamma=0$ or the tiltable guideways 705 are horizontal, where D is the distance between a line along which the central axes of the pins of the upstanding guideways 707 move and the grinding wheel mechanism shaft 401. To the up-and-down plate 708, there is fixed a differential transformer 709 having an armature 710 driven by an armature driving wire 711 trained around a pulley of an electromagnetic clutch 714 and connected to and driven by a wire 712 (described later) driven for tan $\gamma \cdot F'(\alpha)$ cos or a wire 713 (described later) driven for tan $\gamma(R+L \sin t)/R$, where L is the distance from the center of a spherical surface along a conical surface generator, and t is the gradient of the radius. A nut 715 is threaded over an end of the shaft 401 which is rotatably supported by bearings 716, 717. The servomotor 703 is responsive to a deviation between a coil and the armature 710 of the differential transformer 709 for producing a driving force to tilt the grinding wheel mechanism 4 until the deviation will be zero. The arrangement illustrated in FIGS. 12 and 13 therefore tilts the grinding wheel mechanism 4 through the angle of tan $\gamma \cdot F'(\alpha) \cdot \cos \alpha$ or tan $\gamma(R+L \sin t)/R$ at all times.

FIG. 10 illustrates a simple analog calculating mechanism or the mechanism, indicated at 5 in FIG. 1, for calculating the angle of inclination (tan $\gamma \cdot F'(\alpha) \cdot \cos \alpha$) of the grinding wheel mechanism 4 at the time of grinding spherical cutter teeth. Power transmission means 252 (FIGS. 5 and), such as a chain and rotary shaft assembly, transmits power to an input shaft 501. A bevel gear 502 is fixed to the input shaft 501 which introduces an angle of rotation proportional to the angle $\alpha$ of turning movement of the turntable 2. A cam 505 having a cam surface defined by $F'(\alpha) \cdot \cos \alpha$ is fixed to a cam shaft 503 to which is fixed a bevel gear 504 held in mesh with the bevel gear 502. The bevel gear 504 serves to transmit the angle of rotation corresponding to the angle $\alpha$ of turning movement of the turntable 2 and introduced by the input shaft 501, to the cam 505. The cam 505 is corrected in the same manner as the cam 203 in the turntable 2. A straight guideway 508 is supported by a support shaft 507 for reciprocable angular movement. A cam follower 506 disposed on a distal end of the guideway 508 is fitted in a cam way of the cam 505 for angular movement about the support shaft 507 in response to rotation of the cam 505. A guide bar 509 extends parallel to the guideway 508 (in a direction normal to the cam shaft 503) as it is positioned at a cam value of zero of the cam 505. A slider 510 movable in a pattern of tan $\gamma$ is slidably disposed astride of the guide bar 509. The slider 510 includes a cross guideway 511 extending perpendicularly to the guide bar 509 and a slider 512 slidably fitted in the guideway 511 and the guideway 508. A spline shaft 513 extends parallel to the guide bar 509 and through a sprocket wheel 514 sandwiched by a clutch disposed on an extension of the cross guideway 511. An idling sprocket wheel 515 is disposed on the cross guideway 511 remotely from the sprocket wheel 514, with a chain 516 trained around the sprocket wheels 514, 515. The chain 516 has ends fastened to the slider 512 and is subjected to a suitable tension by a spring 517 connected to the chain 516. The slider 510 can be moved laterally by rotating a handle 518' to which an end of a feed screw 518 is fixed. It is assumed that tan $\gamma=0$ when the center of the cross guideway 511 is positioned directly above the support shaft 507, and that the value of a scale (such as 100 mm) (which will be added as a coefficient) established thereby as with the turntable 2 is 1, or tan $\gamma=1$, or $\gamma=45°$, and other values of tan $\gamma$ can be set by moving the cross guideway 511 to the position of the scale x tan $\gamma$. Therefore, if tan $\gamma=0.75$, for example, the central position of the cross guideway 511 should be at 75 mm. The position of the cross guideway 511 and the slider 510 can be determined by viewing, through a window in a box cover, a cursor attached to the slider 510 and a scale mounted on a box of this mechanism. The slider 512 fitted in both the guideway 508 and the cross guideway 511 finally transmits its stroke as tan $\gamma \cdot F'(\alpha) \cos \alpha$ to the wire 712 through the chain 516, the sprocket wheel 514, the spline shaft 513, and a wire rope pulley 513' secured to an end thereof. The wire 712 runs downwardly, then upwardly from a position below the grinding wheel mechanism bearing box 7, and is then trained around a wire rope pulley of the electromagnetic clutch 714.

The foregoing mechanisms of the grinding machine for grinding ball end mills with helical cutter teeth correspond to an attachment for grinding spherical cutter teeth in a known universal grinding machine. As is known in the art, a general ball end mill or milling cutter with helical cutter teeth has plain helical cutter teeth or conical helical cutter teeth. Since the prior universal grinding machine requires two separate attachment for holding such two different ball end mills, at least two chucking processes are required. However, there has a recent demand for a single chucking process for grinding operation. To meet such a demand, the present invention provides an additional arrangement as well as the double differential gear mechanism for the turntable 2, including the mechanism 3 for calculating the angle of rotation of the spindle at the time of grinding plain helical cutter teeth with a constant lead, using a known proportional guideway.

Figure 6:
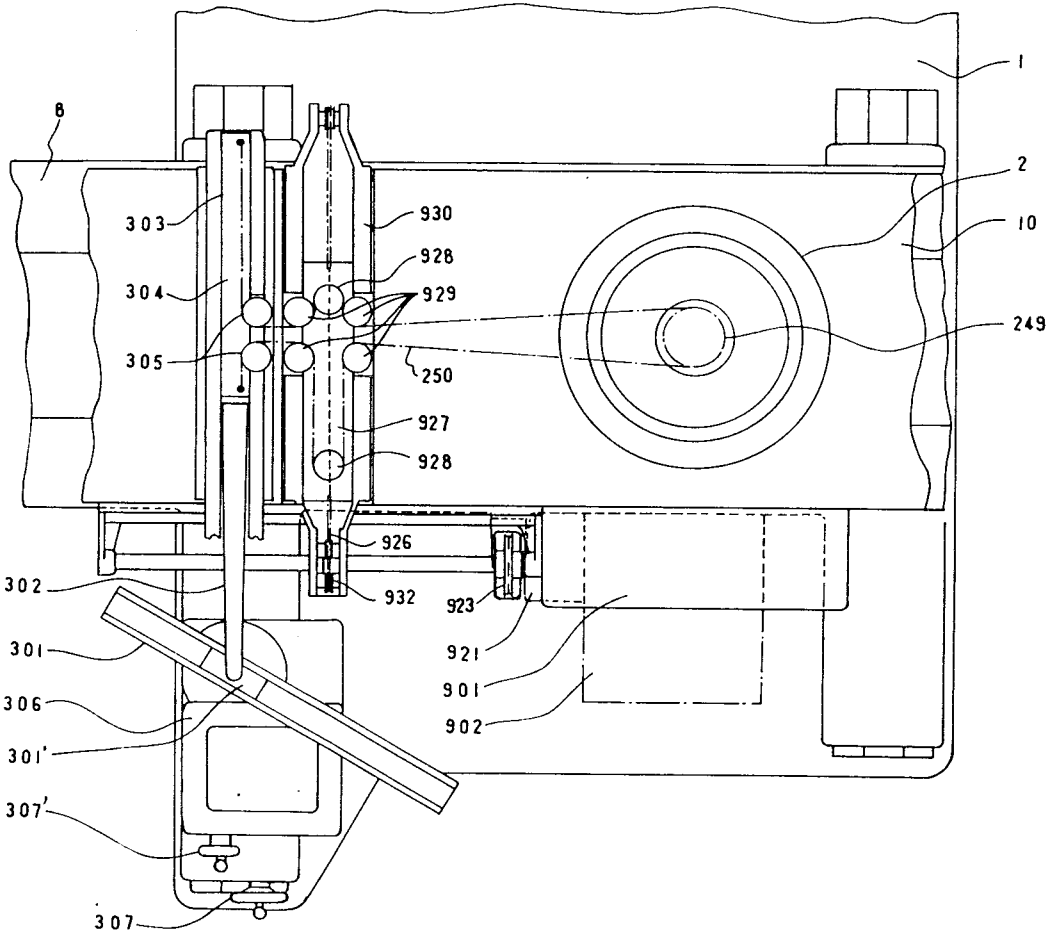
FIG. 6 is a plan view of a drive interval introducing device for a spindle rotating mechanism.

FIG. 6 shows in plan portions of the mechanisms 3, 9 and the bottom of the turntable 2, which are arranged on the X-direction slide table 10. A chain 250 is trained around a sprocket wheel 249 mounted on the bottom of the turntable 2, these members constituting a drive interval introducing device. The proportional guideway 301 is supported for being freely turned and fixed in a horizontal plane, by a support shaft of the pivot base 306 mounted on the Y-direction slide table 8 for being adjustably slidable in the Y direction by a handle 307 for interpolating the separate notch holes in the gear 209 fitted over the spindle 201. The pivot base 306 has a pointer movable with the proportional guideway 301 and a scale movable by a handle 307' to indicate the radius r of the spherical cutter. The scale and the pointer as they intersect provide a reading of tan $\gamma$. A Y-direction guideway 303 is fixedly mounted on the X-direction slide table, and a slider 304 is fitted in the Y-direction guideway 303 for sliding movement in the Y direction. The slider 304 has an extension serving as a connecting rod 302 having an end serving as a junction pin fitted in a slider 301' slidably fitted in the proportional guideway 301. The chain 250 extending from the turntable 2 is trained around idling sprocket wheels 929, 928 of a mechanism (described later) for introducing tan $\gamma \cdot \ln (1+L \tan t/R)/\sin t$, and idling sprocket wheels 305 of the Y-direction guideway 303, and is secured to opposite ends of the slider 304. Such an arrangement is similar to a conventional attachment, which however is of a sixed construction in which the stroke of the slider 304 is transmitted directly to the spindle. For grinding conical helical cutter teeth with the known arrangement, therefore, the X-direction slider 10 should be of a double structure, and the spindle mounted on an attachment secured to an upper portion and the X-direction slider should be inclined with respect to the X-axis while sliding the X-direction slider 10. With the present invention, a slider 927 is fixed, and the spindle 201 can be driven through the chain 250 directly by the stroke of the slider 304 and the slider 301', that is, the stroke of the X-direction slide table 10. Since the proportional guideway 301 is rectilinear, the spindle 201 can be rotated in proportion to the inclination of the proportional guideway 301 and the stroke of the X-direction slide table 10. The spindle 201 can grind helical cutter teeth with a constant lead on the cylindrical or conical surface at a grinding point. The double differential gear device and the known proportional guideway allow in combination an entire ball end mill having plain helical cutter teeth with a constant lead to be ground by one-chucking process. Since conical helical cutter teeth with a constant lead have different helix angles dependent on the position thereon, the grinding wheel mechanism 4 is required to be tilted according to such varying helix angles.

Figure 15:
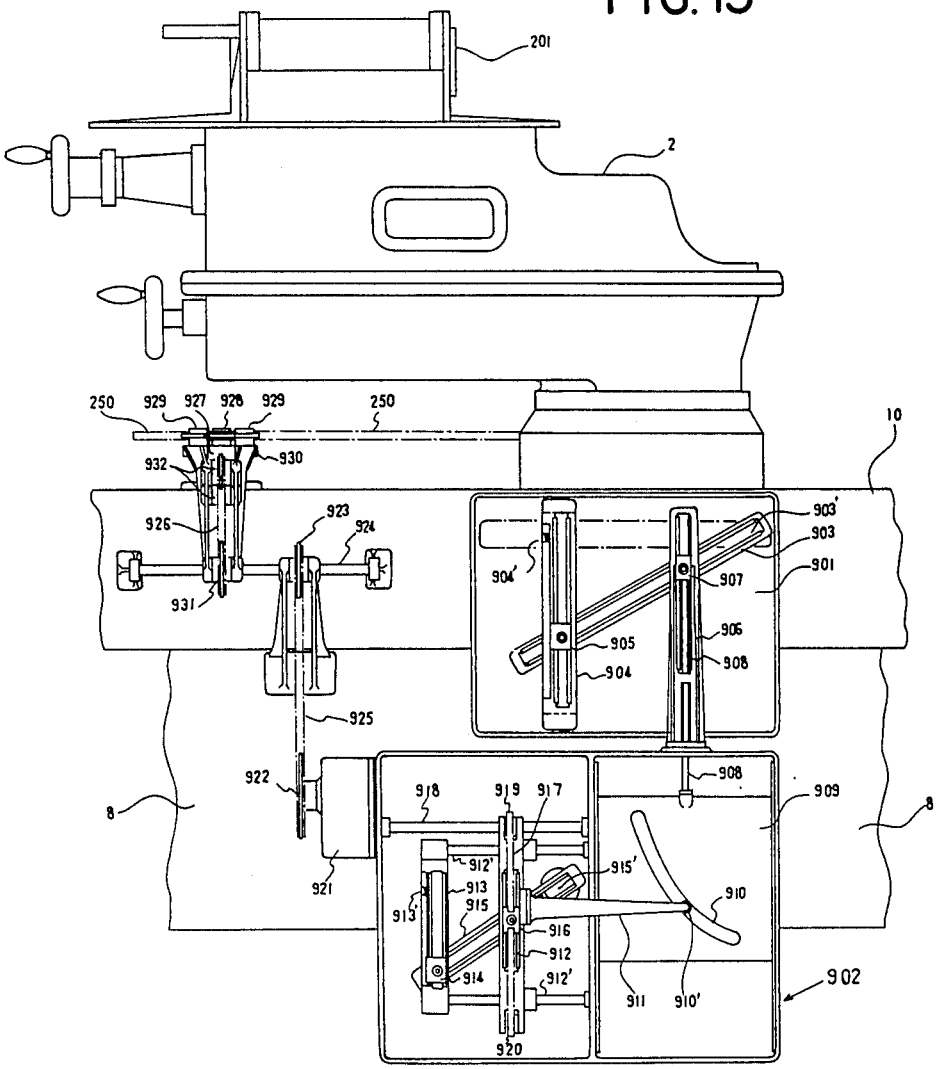
FIG. 15 is a front elevational view of a mechanism for calculating the angle of inclination of a spindle at the time of grinding tapered helical cutter teeth with a constant helix angle.

Conical helical cutter teeth with a constant helix angle have heretofore been difficult to manufacture in desired shapes. This is because as many curved cams as there are different types of conical helical cutter teeth are required for producing them on a profiling lathe, though an axial helix angle B can be expressed by $B=\tan \gamma \cdot \ln (1+L \tan t/R)/\sin t$ as is apparent from a calculation of a function of polar coordinates. According to the present invention, a calculating mechanism having a single logarithmic cam and the turntable 2 having the double differential gear device are combined for allowing easy grinding of a wide variety of ball end mills having conical helical cutter teeth with a constant helix angle through one chucking process. FIG. 15 shows such a calculating mechanism. In FIG. 15, the Y-direction guideway 303 related to the proportional guideway on the X-direction slide table 10 is omitted from illustration, and the components in a logarithmic cam device box or housing 902 for calculating $\tan \gamma \cdot \ln (1+L \tan t/R)/\sin t$ are shown arranged in plan for a better understanding. The Y-direction slide table 8 and the X-direction slide table 10 are shown fragmentarily. A box 901 for calculating tan t/R is fixed to the X-direction slide table 10 and is movable laterally with the X-direction slide table 10, except for an upstanding fixed guideway 906 and its related parts. The logarithmic cam device box 902 is fixed to the Y-direction slide table 8, with a speed-up output gear box 210 mounted on a side wall of the logarithmic cam device box 902. The box 901 houses a tiltable guideway 903 having one end pivotably supported by a pivot shaft 903' and an opposite end fastened to a guideway 904 fixed to the box 901 and also to a slider 905 fitted in the guideways 903, 904 for setting tan t/R. The slope of the tiltable guideway 903 can be known from a scale 904' graduated with values of tan t/R and a cursor attached to the slider 905. Prior to a grinding operation, the value of tan t/R is calculated by a portable calculator, for example, and the tiltable guideway 903 is set to a calculated slope. An upstanding fixed guideway 906 is fixed to the logarithmic cam device box 902 and supports a slider 907 fitted in the guideway 906 and the guideway 903. When the axis of turning movement of the turntable 2, or the Z-axis, intersects the Y-axis, that is, at the position of X=0, the upstanding fixed guideway 906 should be located in such a position that the center of the junction axis of the slider 907 is positioned on the axis of the pivot shaft 903'. A logarithmic cam 909 has a cam way 910 curved as defined by $k \cdot \ln (1+KX)$. The slider 907 is coupled by a connecting rod 908 to the logarithmic cam 909. A longitudinal guideway 912 has ends laterally slidably supported by a guide bar 912'. To the guideway 912, there is fixed a transverse connecting rod 911 having one end supporting a cam follower 910' fitted in the cam way 910. Another longitudinal guideway 913 is fixed to the box 902. A tiltable guideway 915 is pivotably supported at one end by a pivot shaft 915' and has an opposite end fastened to a slider 914 fitted in the guideway 914 and the guideway 915 for setting $\tan \gamma/\sin t$. A point of intersection of the central lines of the guideways 915 and 913 can be read from a scale 913' graduated with values of $\tan \gamma/\sin t$ and a cursor on the slider 914. Therefore, as with tan t/R, the value of $\tan \gamma/\sin t$ is calculated by the portable calculator, and then the slider 914 is fastened in position according to the calculated value to determine the inclination of the tiltable guideway 915. A slider 916 is fitted in both the tiltable guideway 915 and the guideway 912. A chain 917 is fixed to the slider 916 and trained around a sprocket wheel 919 through which a spline shaft 918 extends and an idling sprocket wheel 920. With the foregoing arrangement, when the turntable 2 is turned through t and then fixed, and the X-direction slide table 10 is moved from X=0 to X=L, the slider 907 is depressed by L tan t/R. This motion is transmitted via the connecting rod 908 to the logarithmic cam 909 to move the guideway 912 leftward by $\ln (1+L \tan t/R)$. Then, the slider 916 is lowered by the tiltable guideway 915 and the guideway 912 by a distance of $(\tan \gamma/\sin t) \cdot \ln (1+L \tan t/R)$, that is, $\tan \gamma \cdot \ln (1+L \tan t/R)/\sin t$. This motion is then transmitted by the chain 917 and the sprocket wheel 919 to the spline shaft 918. The motion stroke transmitted to the spline shaft 913 is considerably small, and is speeded up by the speed-up gear box 921. The speeded-up motion is then transmitted through a sprocket wheel 922 and a chain 925 to a sprocket wheel 923 through which a spline shaft 924 extends. The motion is thereafter transmitted from a sprocket wheel 931 through a chain 926 and an idler wheel 932 to a slider 927 sliding in a guideway 930, as shown in FIG. 6. The slider 927 supports an idler wheel 928 close to opposite ends thereof, and the chain 250 is trained around the idler wheel 928 and the fixed sprocket wheels 929, as described above. Therefore, the stroke of the slider 927 is increased and transmitted to the chain 250. The angle of rotation of the spindle 201 on the turntable 2 is proportional to the stroke of the chain 250 as is apparent from the foregoing description subsequent to the double differential gear device for the turntable 2. The angle of rotation of the spindle 201 can be equalized to the above function value of the distance L that the X-direction slide table 10 moves. Since the helix angle is constant at the time of grinding conical helical cutter teeth, the grinding wheel mechanism 4 and the mechanism for calculating the angle of rotation of the spindle at the time of grinding plain helical cutter teeth with a constant lead should be held at rest and may be fixed.

As described above, when grinding a ball end mill having plain helical cutter teeth with a constant lead, the spindle 210 must be angularly moved in proportion to the distance from the center of the spherical surface on the generator, and the helix angle $\gamma$ of the plain helical cutter teeth remains constant at any point. However, although the angle of rotation of the spindle is constant in grinding conical helical cutter teeth with a constant lead, the helix angle $\gamma'$ of conical helical cutter teeth varies in a pattern of $\tan \gamma' = \tan \gamma (R + L \sin t)/R$ ($R$ = the radius of the spherical surface at end, $t$ = the gradient of the radius of a conical surface circumscribing the conical helical cutter teeth, and $\gamma$ = the helix angle of the helical cutter teeth at the junction point) dependent on the distance L from the center of the end.

Figure 11:
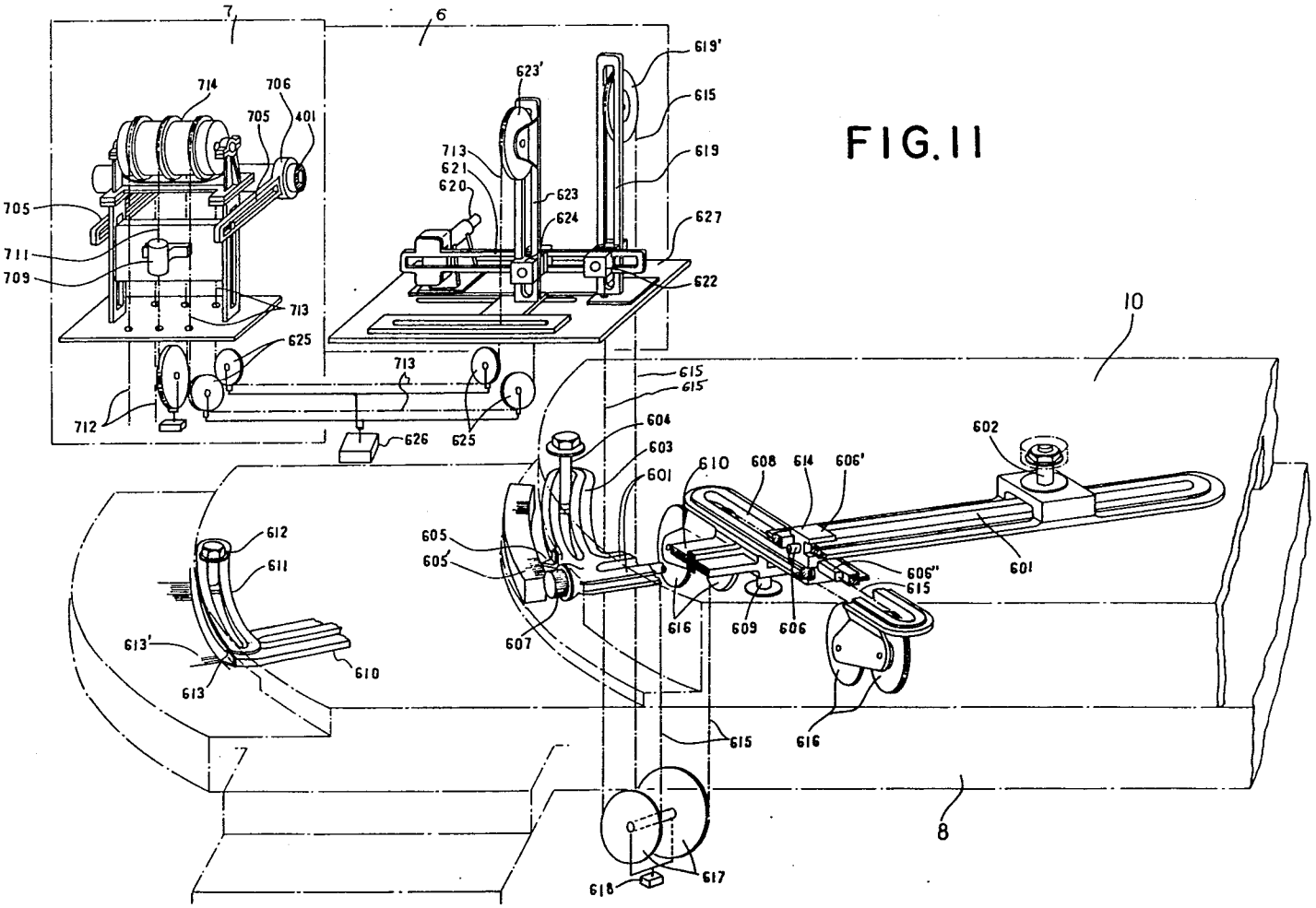
FIG. 11 is a perspective view of a mechanism for calculating the angle of inclination of the grinding wheel mechanism at the time of grinding tapered helical cutter teeth with a constant lead.

FIG. 11 shows a mechanism for calculating the angle of inclination of the grinding wheel mechanism at the time of grinding conical helical cutter teeth with a constant lead to determine $\tan \gamma (R + L \sin t)/R$. The mechanism 6 for calculating $\tan \gamma (R + L \sin t)/R$ is housed in the block designated at 6 in FIG. 1. The mechanism 7 is housed in the block designated at 7 in FIG. 1, and is illustrated in detail in FIG. 7. The Y-direction slide table 8 and the X-direction slide table 10 are shown fragmentarily. A bottom guideway 601 and an orthogonal arm 610 of a perpendicular guideway 608 (described later) are shown with parts broken away. The bottom guideway 601 is suspended for reciprocable angular movement from the X-direction slide table 10 by a support shaft 602 close to a righthand end of the bottom guideway 601. The other end of the bottom guideway 601 terminates in an arcuate arm 603 having an arcuate slot with its center of curvature being on the support shaft 602. The arcuate arm 603 is held atainst a lower surface of the X-direction slide table 10 by a bolt 604, which can be tightened or loosened on the surface of the X-direction slide table 10. A cursor 605 is fixed to an outer side of the arcuate arm 603 and extends through a window defined in the X-direction slide table 10. An angle scale 605', shown fragmentarily, is mounted on the X-direction slide table 10, and graduated with angles. The bottom guideway 601 can be angularly oriented and fastened in place at the radius gradient t of the ball end mill having conical helical cutter teeth, t being the angle read by the cursor 605 on the scale 605'. When the cursor 605 is set to $t=0$, the bottom guideway 601 must lie parallel to the X-axis. The perpendicular guideway 608 is supported for reciprocable angular movement by a pivot shaft 609 on the Y-direction slide table 8. The pivot shaft 609 is located so as to be directly below the pivot shaft 602 of the bottom guideway 601 when the X-direction slide table 10 is in the position of $X=0$, that is, the position in which the Z-axis of the turntable 2 intersects the Y-axis. The orthogonal arm 610 of the perpendicular guideway 608 terminates in an arcuate arm 611 having an arcuate slot with its center of curvature being on the pivot shaft 609. The perpendicular guideway 608 can be oriented in a desired direction t and tightened or loosened in that direction by a bolt 612 extending through the arcuate slot in the arcuate arm 611. The end of the orthogonal arm 610 also has a cursor 613 for reading an angle of the perpendicular guideway 608 from an angle scale 613'. When the angle $t=0$, the perpendicular guideway 608 must lie in alignment with the direction in which the X-direction slide table 10 slides or the direction normal to the X-axis direction. A slider 614 is slidably fitted in both the bottom guideway 601 and the perpendicular guideway 608, and an elongate shaft 606 extends through the slider 614 along the direction of the bottom guideway 601. The slider 614 is of a relatively complex construction, and has a pinion 606' nonrotatably but axially slidably fitted over the elongate shaft 606. A rack 606'' in mesh with the pinion 606' is disposed in the perpendicular guideway 608 and movable in the direction thereof. A wire rope 615 has ends fixed to opposite ends of the rack 606'', are trained around idler wheels 616, 617, 619', held under tension by a weight 618, and have ends secured to a slider 622 in the mechanism 6. When grinding spherical cutter teeth of a ball end mill with conical helical cutter teeth, the Z-axis of turning movement of the turntable 2 must be aligned with the Y-axis. The spindle 201 should be tilted from the X-axis by the gradient t of the radius of the conical surface at the time of grinding the conical helical cutter teeth. The conical helical cutter teeth which are ground are joined to the spherical cutter teeth at a point where an angle of elevation $\alpha = t$. At this time, the bottom guideway 601 and the perpendicular guideway 608 are fastened by the bolts 604, 612, and the elongate shaft 606 is turned by turning a knob 607 and then fixed so that the rack 606'' can be moved by the radius of the spherical cutter teeth. With the parts thus adjusted, the X-direction slide table 10 is mvoed L t the right to move the slider 614 from the reference position of $X=0$ by an interval of L sin t, whereupon the wire rope 615 move by an interval of $R + L \sin t$.

The mechanism 6 for calculating $\tan \gamma (R + L \sin t)/R$ will hereinafter be described. An upstanding guideway 619 is fixed to a base table 627 and supports on an upper end thereof an idling wheel 619' around which the wire rope 615 is trained. A tiltable guideway 621 is supported by a pivot shaft 620 for tiltable movement with respect to the upstanding guideway 619. The slider 622 to which the wire ropes 615 are secured is fitted in both the upstanding guideway 619 and the tiltable guideway 621. A movable upstanding guideway 623 is movable parallel to the tiltable guideway 621 and can be brought to a position corresponding to $\tan \gamma/R$. A slider 624 is fitted in both the movable guideway 623 and the tiltable guideway 621 and fixed to a wire rope 713 trained around an idling wheel 623' mounted on an upper portion of the movable upstanding guideway 623. The wire rope 713 is also trained around idling wheels 625 and wire rope pulleys of an electromagnetic clutch 714 in the grinding wheel mechanism bearing box 7, and is tentioned by a weight 626. When the movable upstanding guideway 723 is spaced $\tan \gamma/R$ from the pivot shaft 620, R on the knob 607 is set to "0", and the X-direction slide table 10 is positioned at $X=0$, then the interval of movement of the wire rope 615 must be zero. Under this condition, the tiltable guideway 621 is adjusted so as to lie horizontally in a reference position. Then, the knob 607 is used to set the rack 606'' to a given radius R, and the X-direction slide table 10 is moved the distance L, whereupon the slider 622 is lifted the interval $R + L \sin t$. Provided the upstanding guideway 619 is spaced k from the pivot shaft 620, the slider 624 on the movable upstanding guideway 623 is pushed upwardly ($\tan \gamma/R$)

$(R+L \sin t)/k = \tan \gamma(R+L \sin t)/Rk$. If k is corrected in another way since it is invariable, the slider 624 can be considered as being lifted $\tan \gamma(R+\sin t)/R$. That is, the wire rope 713 is moved by the above distance. Therefore, when the electromagnetic clutch 714 is switched toward the wire rope 713, the grinding wheel mechanism 4 as a whole is tilted $\gamma'$ of $\tan \gamma' = \tan \gamma(R+L \sin t)/R$ by appropriately selecting the distance of an upstanding guideway 707 from the central axis dependent on the above interval of movement. Conical helical cutter teeth with a constant lead can be ground in this manner, and immediately thereafter the electromagnetic clutch 714 in the grinding wheel mechanism bearing 7 is switched to turn the turntable 2, so that spherical cutter teeth can be ground without changing the junction point.

Figure 14:
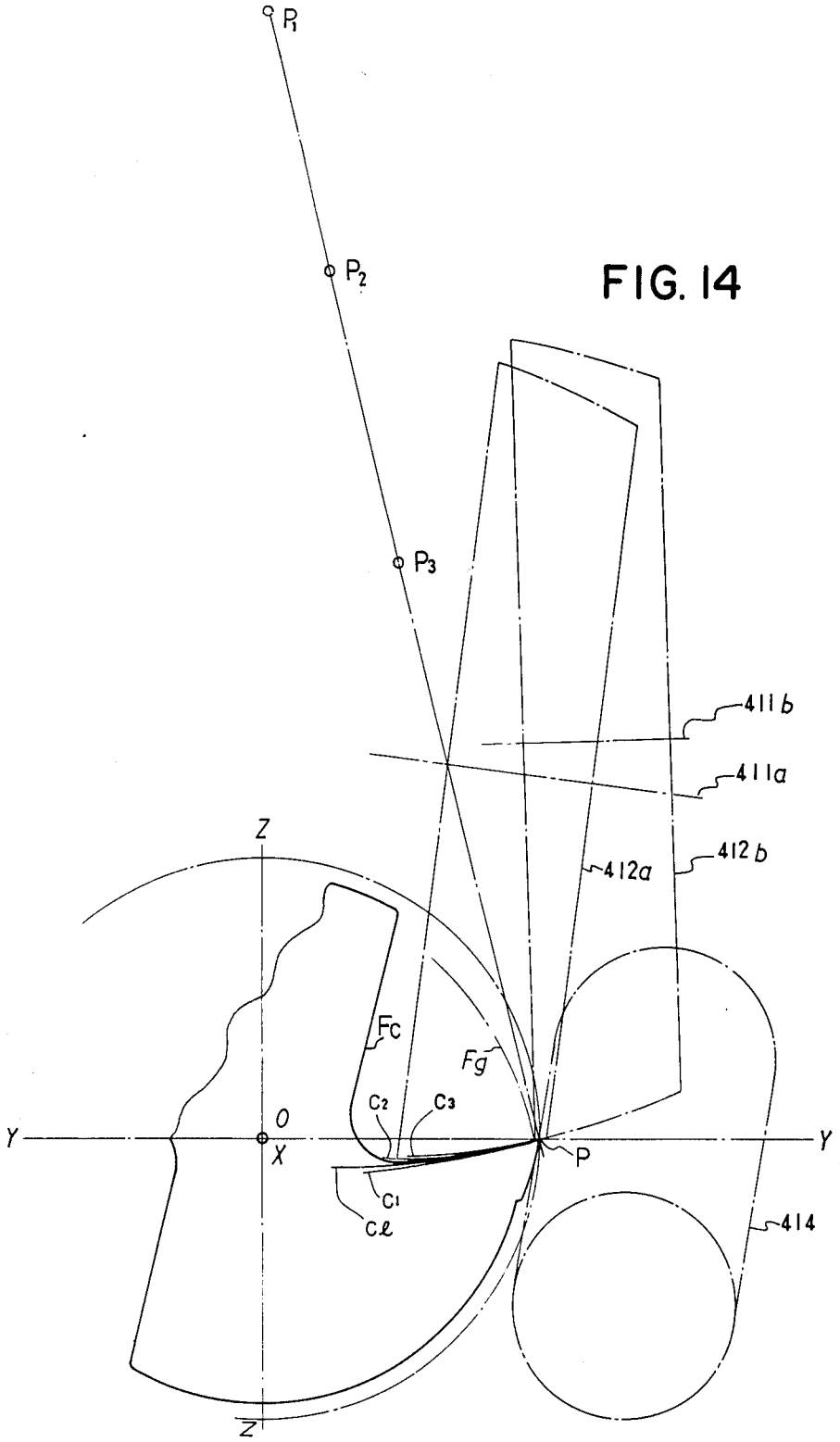
FIG. 14 is a schematic diagram showing the positional relationship between a face grinding wheel and a flank grinding wheel at the time of grinding spherical cutter teeth and the maner in which the face grinding wheel moves.

There is a point to be considered further in grinding spherical cutter teeth, and such a point will be described with reference to FIG. 14. As is known in the art, a back surface in front of the face of a clearance groove in plain or conical helical cutter teeth is the back surface of a helical cutter tooth positioned ini front of a helical tooth constituted by the above face. The back surface extends toward a spherical cutter tooth and terminates in a flank of the front spherical cutter tooth as it reaches its tip end. Where there are a number of cutter teeth, the width of the face of each cutter tooth is zero provided each cutter tooth reaches the tip end. However, such spherical cutter teeth cannot be ground at the tip end, and are difficult to manufacture in practice. Therefore, in general, only one complete cutter tooth having at least narrow face even at the tip end is left while removing portions of other cutter teeth in the vicinity of the tip end. In this case, as described above, the face width has to be reduced as the angle of elevation $\alpha$ is increased, or as the angle of rotation of the turntable 2 is increased upon grinding. A curve in which the rake angle of a face is constant even if the radius of an outer peripheral surface is reduced due to wear is a logarithmic helix with its radius of curvature being expressed by R cosec where R is the radius of curvature of the outer peripheral surface and $\delta$ is the rake angle. Since the face is excessively ground at a grinding point following the face, the radius of curvature from this point should be small. The center of curvature of the face should be located on a line normal to the face at its cutting edge. In FIG. 14, the rake angle $\delta$ is 13.5°. Designated at cl is a logarithmic helix expressed by $\ln r/R = -\theta \cot \delta$, $=13.5°$, and c1, c2, c3 are curves drawn by putting the centers of arcs with their radii of curvature being 1, 0.75, and 0.5 times that of the curve of cl at the cutting edge, on lines P1, P2, P3, respectively, normal to the face at the cutting edge. According to the present invention, the flang grinding wheel 414 should be located so that a generated cutter edge will be positioned at a point p on the Y-axis, as described before. By turning the turntable 2 about the Z-axis, the flank of a spherical cutter tooth on the end of a ball end mill fixed to the spindle 201 mounted on the turntable 2 can be ground about the Z-axis. As illustrated in FIG. 14, the face of the spherical cutter tooth should change from a clearance groove p in plain helical cutter teeth to a face to Fc to a face p at the tip end of a spherical cutter tooth to a narror face to Fg, and such a change should be made while the turntable 2 turns. According to the present invention, the center 404 of rotation of the arcuate swing body 406 supporting the two grinding wheels in the grinding wheel mechanism 4 is established on a point, such as P2, on the line normal to the face at the cutting edge, and a peripheral edge surface of a grinding wheel 412 indicated by the dot-and-dash line is finished so as to have a radius of curvature equal to that of the face. By then turning the arcuate swing body 406 with the turning movement of the turntable 2, the face grinding wheel 412*a* is retracted to the position indicated by 412*b*. While the face is being thus ground, the flank grinding wheel should be detached. In the grinding machine of the invention, the above retracting movement is effected by a drive force which is appropriately increased or reduced in speed by the Norton gear box 11 driven by the mechanism 5 and which is introduced to the feed mechanism 405' for the arcuate swing body by the flexible shaft 418. When grinding a flank in spherical cutter teeth, any retracting movement of the flank grinding wheel similar to the retracting movement of the face grinding wheel upon grinding a face in spherical cutter teeth is not required, but is harmful. Therefore, for grinding the flank, the coupling should be separated by the clutch in the feed mechanism 405' to disconnect the feed mechanism 405' from the flexible shaft 418 for thereby keep the swing body 406 fixed.

As described above, it is apparent that a spherical cutter tooth ground by the grinding machine of the present invention can be expressed by $\beta = \tan \gamma \cdot F(\alpha)$ where $\alpha$is the angle of elevation and $\beta$ is the azimuth angle. The form of $F(\alpha)$ will now be considered. In order for a plain helical cutter tooth and a spherical cutter tooth as they are generated to be fully joined without any bent edge at the position of $\alpha=0$ in $F'(\alpha)$-$\cos \alpha$, that is the junction point between the cutter teeth, the angles of inclination of the cutter teeth should be equal to each other. Therefore, the slope on the side of the spherical cutter tooth at this junction point should be $\tan \gamma$. The slope of the spherical cutter tooth will be expressed with tan used as a parameter by $\tan \gamma = \tan \gamma \cdot F'(\alpha) \cos$ [$F(\alpha)$ is a simple function represented on a plane, and the representation of a slope on a spherical surface using this function is multiplied by the coefficient of $\cos \alpha$]. $\alpha$ of the $F(\alpha)$ spherical cutter tooth should reach 90° or the tip end in view of the characteristics of the cutter tooth. If $F'(\alpha)$ has a large value in the vicinity of the tip end, then there is drawn a curve similar to a helix of multiple turns or an extremely small radius. An expected spherical cutter tooth in the vicinity of the tip end should be as straight as possible. According to the present invention $F'(\alpha)=0$ or a small positive value in the range of $\alpha=60°$ to 90°, and no bent edge should be present in the vicinity of a point where $F'(\alpha)=0$ is reached. Therefore, the spherical cutter tooth should be tangential to a longitudinal line or intersect the longitudinal line at a minimum value of $\alpha$ within the above angle range. A simple plane function curve which meets the above requirements can be expressed by an algebraic formula of second or higher degree. Any curves tend to become more angular as their algebraic formulas are of higher degree. For example, a quadratic expression which is tangent to a longitudinal line in which $\alpha=70$ and $\beta=35$ and which meets $F'(0)=1$ is a parabola. The face is centrally concave beyond a central line passing through the cutting edge in relation to the rake angle. The above example is not enough to prevent the generation of an edge loss or defect even at the deepest concavity. One example of $F(\alpha)$ in which any edge loss is sufficiently prevented even at the helix angle of $\gamma=30°$ is $[(F(\alpha)+135.44)/166.81]^2+[(\alpha-70)/119.92]^2=1$. This example is applicable to a range of $\gamma > 29°$ provided a spherical cutter tooth with a barely remaining face in the range of $\gamma > 30_o$or $\gamma < 30°$ is allowed. The planar form of $F(\alpha)$ in this example is elliptic. F(a) in which the minimum helix angle $\gamma$ is 25°, 20°, 15°, or the like of a plain helical cutter tooth for producing defect-free cutter tooth can similarly be determined as disclosed in the patent application entitled "Ball end mill with plain or tapered helical cutter teeth having a large helix angle and a large rake angle" filed by the inventor.

The helix angle of a spherical cutter tooth at any desired point with respect to a longitudinal line can also be expressed by $\tan \gamma = \tan \Gamma \cdot F'(\alpha) \cos \alpha$. The angle of elevation $\alpha$ of a junction point between a conical helical cutter tooth having a radius gradient t and a spherical surface is equal to t. The above equation can be modified into $\tan \gamma = \tan \Gamma \cdot F'(t) \cos t$, or $\tan \Gamma = \tan \gamma / F'(t) \cos \tau$. [Since $F'(t) < 1$ and $\cos t < 1$, $\tan \Gamma > \tan \gamma$.]The above $\tan \Gamma$ is the value of a parameter for giving a helix angle $\gamma$ to a spherical cutter tooth at $\alpha = t$, $\Gamma$ being called an equivalent helix angle of a plain helical cutter tooth. When grinding a ball end mill with conical helical cutter teeth having a radius gradient t, the turntable 2 and the mechanism for setting $\tan \gamma$ in the mechanism for calculating the angle of inclination of the grinding wheel mechanism at the time of grinding spherical cutter teeth should be set to $\tan \Gamma$. It is rather complex to calculate $1/F'(t) \cos t$ for each desired t. Therefore, it would be convenient to represent the above equation as a graphic pattern.

The fundamental arrangement of the present invention is different from a conventional ball end mill grinding mechanism having a Y-direction slide table on a fixed base, and a turntable supporting an X-direction slide table and a spindle to which a ball end mill to be ground can be fixed and angularly movable about a Z-axis perpendicularly intersecting X- and Y-axes parallel to X and Y directions which intersect at a point 0 on a central axis of the spindle. According to the fundamental arrangement of the invention, the grinding machine has a turntable for turning a spindle through an angle of turning movement having a reference position in which the spindle extends parallel to the X-axis, in a pattern of $\tan \gamma \cdot F(\alpha)$ ($\gamma$ is the helix angle of a point where a plain or conical helical cutter tooth is joined to a spherical cutter tooth, $F(\alpha)$ is called a basic function of the spherical cutter tooth, expressing an azimuth angle $\beta$ as a function of an angle of elevation wherein a point on the spherical surface is expressed by these angles with the point where the spherical cutter tooth is joined to the plain helical cutter tooth serving as a reference point. The angle of elevation $\alpha$ of the spherical cutter tooth is given by turning movement of the turntable upon grinding the ball end mill, and hence is equal to the angle of turning movement of the turntable, falling in the range of $0° < \alpha < 90°$. The grinding machine of the invention also has a grinding wheel mechanism tiltable laterally about the Y-axis and having grinding wheel shafts for alternatively supporting face and flank grinding wheels in a manner to contact a cutter tooth being generated at a given inclination, the grinding wheel mechanism having a device for moving the grinding wheel shafts in order to enable the tip end of the cutter tooth to lie in a prescribed point on the Y-axis at all times. In response to the turning movement of the turntable, the overall mechanism is tiltable in a pattern of $\tan \gamma \cdot F'(\alpha) \cos \alpha$ ($F'(\alpha)$ is a derivative of $F(\alpha)$) so as to enable the face grinding wheel to have its grinding surface to geometrically contact the curved surface of the spherical cutter tooth at the cutting edge thereof in a prescribed point on the Y-axis, and also enable the flank grinding wheel to contact the curved cutting edge of the spherical cutter tooth in a constant relationship at all times dependent on the shape of the flank (which may be either a convex surface, a straight surface, or a concave surface).

To improve the function of the grinding machine according to the above fundamental arrangement, the turntable has a double differential gear device for rotating the spindle by a drive force applied from an external source while the turntable is held at rest when grinding plain helical cutter teeth of a constant lead and and for rotating the spindle in a pattern of $\tan \gamma \cdot F(\alpha)$ in response to turning movement of the turntable through a cam device irrespectively of the position of X- and Y-direction slide tables.

Furthermore, the grinding machine of the invention also includes a calculating mechanism for tilting the grinding wheel mechanism in a pattern of $\tan \gamma' = \tan \gamma \cdot (R + L \sin t)/R$ when grinding conical helical cutter teeth having a constant lead.

Furthermore, the grinding machine of the invention also includes a calculating mechanism for angularly moving the spindle in a pattern of $B = [\tan \gamma \cdot \ln (1 + L \tan t/R)]/ \sin t$ when grinding conical helical cutter teeth having a constant helix angle.

The grinding machine of the present invention therefore can grind a ball end mill or milling cutter having plain or conical helical cutter teeth which are in a practically sufficient range and are complete. The calculating mechanism and the drive mechanism can be replaced with an electronic calculating device and a servomechanism or automated mechnaism drivable thereby.

Although a certain preferred embodiment has been shown and described, it should be understood that many changes and modifications may be made therein without departing from the scope of the appended claims.

What is claimed is:

1. A grinding machine for grinding cutter teeth on a ball and mill, comprising:

a machine base;

a Y-direction slide table disposed over said machine base and movable back and forth thereon;

an X-direction slide table disposed over the Y-direction slide table and movable right and left thereon;

a proportional guideway fixed on the Y-direction slide table and being freely rotatable about a perpendicular axis;

a spindle and a turntable having means for turning the spindle through an angle $\alpha$ of turning movement having a reference position in which the spindle extends parallel to an X-axis, in a pattern of $\tan \gamma \cdot F(\alpha)$ where $\gamma$ is the helix angle of helical cutter teeth to be ground on the ball end mill, the turntable including a turntable base fixedly mounted on the X-direction slide table, swivel base box means rotatably mounted on and projecting sidewardly of the turntable base, the spindle being disposed over the sidewardly projecting swivel base box means for mounting a workpiece, and a F ($\alpha$) cam means disposed in the swivel base box means;

a grinding wheel mechanism tiltable laterally about a Y axis and having grinding wheel shafts for alternatively supporting face and flank grinding wheels and means for moving the grinding wheel shafts to enable the tip end of a cutter tooth being generated on said ball end mill to lie in a prescribed point on the Y-axis at all times, the mechanism as a whole being tiltable dependent on the turning movement of the turntable in a pattern of $\tan \gamma \cdot F'(\alpha) \cdot \cos \alpha$ so as to enable the face grinding wheel to have its grinding surface geometrically contact the curved surface of a spherical cutter tooth at the cutting edge thereof in a prescribed point on the Y-axis, and also enable the flank grinding wheel to contact the curved cutting edge of the spherical cutter tooth in a constant relationship at all times dependent on the shape of the flank;

a first mechanism disposed over the machine base and to the rear of the Y-direction slide table for calculating the angle of inclination of the grinding wheel mechanism at the time of grinding tapered helical cutter teeth with a constant lead;

a bearing box disposed over the first mechanism and to the rear of the swivel base box means, the face grinding wheel shaft having an axis in the Y-axis direction and the flank grinding wheel shaft having an axis in the X-axis direction respectively disposed in front of the bearing box and rotatable and adjustable vertically at about an axis parallel to the X-axis;

a second mechanism arranged over the bearing box and disposed over the first mechanism for calculating the angle of inclination of the grinding wheel mechanism.

2. A grinding machine according to claim 1, wherein the turntable has a double differential gear device having means (1) for rotating the spindle by a drive force applied from an external source while the turntable is held at rest when grinding plain helical cutter teeth of a constant lead and (2) for rotating the spindle in a pattern of $\tan \gamma \cdot F(\alpha)$ in response to the turning movement of the turntable through a cam device irrespectively of the position of X- and Y-direction slide tables.

3. A grinding machine according to claim 1, including a calculating means for tilting the grinding wheel mechanism in a pattern of $\tan \Gamma = \tan \gamma \cdot (R + L \sin t)/R$ when grinding the conical helical cutter teeth having a constant lead, where L = the distance from a junction point with conical helical cutter teeth being ground, t = the radius gradient of a conical surface circumscribing the conical helical cutter teeth, R = the radius of a spherical surface of spherical cutter teeth at an end of the ball end mill, $\Gamma$ = the helix angle of the helical cutter teeth at a point L, and $\gamma$ = the helix angle of the helical cutter teeth at the junction point.

4. A grinding machine according to claim 1, including a calculating means for angularly moving the spindle in a pattern of $B = \tan \gamma \cdot \ln (1 = L \tan t/R)/\sin t$ when grinding conical heical cutter teeth having a constant helix angle, where L = the distance from a junction point with conical helical cutter teeth being ground, t = the radius gradient of a conical surface circumscribing the conical helical cutter teeth, R = the radius of a spherical surface of spherical cutter teeth at an end of the ball end mill, $\gamma$ = the helix angle of the helical cutter teeth at the junction point.

* * * * *

UNITED STATES PATENT AND TRADEMARK OFFICE

CERTIFICATE OF CORRECTION

PATENT NO. : 4 619 079

DATED : October 28, 1986

INVENTOR(S) : Morio KIDANI

It is certified that error appears in the above-identified patent and that said Letters Patent is hereby corrected as shown below:

Column 18, Line 44; Change "ball and mill" to ---ball end mill---.

Signed and Sealed this

Twenty-eighth Day of April, 1987

*Attest:*

DONALD J. QUIGG

*Attesting Officer*

*Commissioner of Patents and Trademarks*